US009421756B1

(12) United States Patent
Smith et al.

(10) Patent No.: US 9,421,756 B1
(45) Date of Patent: Aug. 23, 2016

(54) ROLLER CONTACT ADJUSTMENT FOR FLEXOGRAPHIC PRINTING SYSTEM

(71) Applicants: Gary A. Smith, Rochester, NY (US); James Douglas Shifley, Spencerport, NY (US)

(72) Inventors: Gary A. Smith, Rochester, NY (US); James Douglas Shifley, Spencerport, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/694,194

(22) Filed: Apr. 23, 2015

(51) Int. Cl.
*B41F 31/06* (2006.01)
*B41F 5/24* (2006.01)
*B41F 31/13* (2006.01)

(52) U.S. Cl.
CPC ..... *B41F 31/06* (2013.01); *B41F 31/13* (2013.01); *B41F 5/24* (2013.01)

(58) Field of Classification Search
CPC ..... B41F 5/24; B41F 31/02; B41F 31/06; B41F 31/07
See application file for complete search history.

(56) References Cited

U.S. PATENT DOCUMENTS

| | | | | |
|---|---|---|---|---|
| 2,988,989 | A * | 6/1961 | Crawford | B41F 9/01 101/152 |
| 3,180,257 | A * | 4/1965 | Shields | B41F 31/00 101/154 |
| 3,589,287 | A * | 6/1971 | Woessner | B41F 31/07 101/216 |
| 3,818,830 | A * | 6/1974 | Schultz | B41F 31/06 101/350.5 |
| 5,088,407 | A * | 2/1992 | Helm | B41F 5/24 101/352.01 |
| 7,487,724 | B1 | 2/2009 | Evans et al. | |
| 7,984,673 | B2 * | 7/2011 | Rousseau | B41F 13/34 101/331 |
| 2012/0186470 | A1 | 7/2012 | Marco et al. | |

* cited by examiner

*Primary Examiner* — Matthew G Marini
*Assistant Examiner* — Leo T Hinze
(74) *Attorney, Agent, or Firm* — Kevin E. Spaulding

(57) ABSTRACT

A method for adjusting an extent of contact between a fountain roller mounted within a pivotable ink pan and an anilox roller in a flexographic printing system, the pivotable ink pan being adapted to pivot around a pivot axis disposed proximate to a first end of the pivotable ink pan. The pivotable ink pan is positioned to provide a predetermined gap between the anilox roller and the fountain roller by inserting a shim between the fountain roller and the anilox roller. The position of the pivotable ink pan is adjusted by adjusting a height of a distal portion of the pivotable ink pan by a predetermined amount that is known to close the predetermined gap to a desired extent. The position of the pivotable ink pan is then locked such that the distal portion of the pivotable ink pan is maintained at the adjusted height.

10 Claims, 15 Drawing Sheets

ROLLER CONTACT ADJUSTMENT FOR FLEXOGRAPHIC PRINTING SYSTEM

CROSS-REFERENCE TO RELATED APPLICATIONS

Reference is made to commonly-assigned, co-pending U.S. patent application Ser. No. 14/146,867 (now U.S. Publication No. 2015/0191006), entitled "Inking system for flexographic printing," by J. Shifley; to commonly-assigned U.S. patent application Ser. No. 14/162,807 (now U.S. Pat. No. 9,233,531), entitled "Flexographic printing system with solvent replenishment," by J. Shifley et al.; to commonly-assigned, co-pending U.S. patent application Ser. No. 14/296,513 (now U.S. Publication No. 2015/0352835), entitled "Solvent replenishment using density sensor for flexographic printer," by S. Haseler et al.; to commonly-assigned, co-pending U.S. patent application Ser. No. 14/524,247, entitled "Flexographic ink recirculation with anti-air-entrainment features," by Shifley et al.; and to commonly-assigned, co-pending U.S. patent application Ser. No. 14/694,172, entitled "Flexographic printing system with pivoting ink pan," by Smith et al, each of which is incorporated herein by reference.

FIELD OF THE INVENTION

This invention pertains to the field of flexographic printing, and more particularly to adjustable ink pans for controllably providing ink to an anilox roller.

BACKGROUND OF THE INVENTION

Flexography is a method of printing or pattern formation that is commonly used for high-volume printing runs. It is typically employed for printing on a variety of soft or easily deformed materials including, but not limited to, paper, paperboard stock, corrugated board, polymeric films, fabrics, metal foils, glass, glass-coated materials, flexible glass materials and laminates of multiple materials. Coarse surfaces and stretchable polymeric films are also economically printed using flexography.

Flexographic printing members are sometimes known as flexographic printing plates, relief printing members, relief-containing printing plates, printing sleeves, or printing cylinders, and are provided with raised relief images onto which ink is applied for application to a printable material. While the raised relief images are inked, the recessed relief "floor" should remain free of ink.

Although flexographic printing has conventionally been used in the past for printing of images, more recent uses of flexographic printing have included functional printing of devices, such as touch screen sensor films, antennas, and other devices to be used in electronics or other industries. Such devices typically include electrically conductive patterns.

Touch screens are visual displays with areas that may be configured to detect both the presence and location of a touch by, for example, a finger, a hand or a stylus. Touch screens may be found in televisions, computers, computer peripherals, mobile computing devices, automobiles, appliances and game consoles, as well as in other industrial, commercial and household applications. A capacitive touch screen includes a substantially transparent substrate which is provided with electrically conductive patterns that do not excessively impair the transparency—either because the conductors are made of a material, such as indium tin oxide, that is substantially transparent, or because the conductors are sufficiently narrow that the transparency is provided by the comparatively large open areas not containing conductors. As the human body is also an electrical conductor, touching the surface of the screen results in a distortion of the screen's electrostatic field, measurable as a change in capacitance.

Projected capacitive touch technology is a variant of capacitive touch technology. Projected capacitive touch screens are made up of a matrix of rows and columns of conductive material that form a grid. Voltage applied to this grid creates a uniform electrostatic field, which can be measured. When a conductive object, such as a finger, comes into contact, it distorts the local electrostatic field at that point. This is measurable as a change in capacitance. The capacitance can be changed and measured at every intersection point on the grid. Therefore, this system is able to accurately track touches. Projected capacitive touch screens can use either mutual capacitive sensors or self capacitive sensors. In mutual capacitive sensors, there is a capacitor at every intersection of each row and each column. A 16×14 array, for example, would have 224 independent capacitors. A voltage is applied to the rows or columns. Bringing a finger or conductive stylus close to the surface of the sensor changes the local electrostatic field which reduces the mutual capacitance. The capacitance change at every individual point on the grid can be measured to accurately determine the touch location by measuring the voltage in the other axis. Mutual capacitance allows multi-touch operation where multiple fingers, palms or styli can be accurately tracked at the same time.

WO 2013/063188 by Petcavich et al. discloses a method of manufacturing a capacitive touch sensor using a roll-to-roll process to print a conductor pattern on a flexible transparent dielectric substrate. A first conductor pattern is printed on a first side of the dielectric substrate using a first flexographic printing plate and is then cured. A second conductor pattern is printed on a second side of the dielectric substrate using a second flexographic printing plate and is then cured. In some embodiments the ink used to print the patterns includes a catalyst that acts as seed layer during subsequent electroless plating. The electrolessly plated material (e.g., copper) provides the low resistivity in the narrow lines of the grid needed for excellent performance of the capacitive touch sensor. Petcavich et al. indicate that the line width of the flexographically printed material can be 1 to 50 microns.

To improve the optical quality and reliability of the touch screen, it has been found to be preferable that the width of the grid lines be approximately 2 to 10 microns, and even more preferably to be 4 to 8 microns. Printing such narrow lines stretches the limits of flexographic printing technology, especially when relatively high viscosity printing inks are used. In particular, it has been found to be difficult to achieve a desired tolerance of plus or minus one micron in line width tolerance.

The ink used to print the patterns used for electroless plating typically includes one or more UV curable monomers or polymers in which a catalyst is dispersed, and an amount of solvent to provide good flexographic printing characteristics. The ink is typically transferred to the flexographic printing members using anilox rollers. In some configurations, ink is transferred from an ink pan to the anilox rollers using fountain rollers mounted in the ink pan. Any variation of the contact pressure between the fountain rollers and the anilox rollers can result in inconsistent or unreliable transfer of ink, which can impact the ability of the flexographic printing system to deliver the required tolerances in the features of the printed images. There remains a need for ink pan configurations and adjustment methods which enable the extent of contact between a fountain roller and an anilox roller in a flexographic printing system to be adjusted in an accurate and consistent manner.

SUMMARY OF THE INVENTION

The present invention represents a method for adjusting an extent of contact between a fountain roller mounted within a pivotable ink pan and an anilox roller in a flexographic printing system, the pivotable ink pan being adapted to pivot around a pivot axis disposed proximate to a first end of the pivotable ink pan, comprising:

positioning the pivotable ink pan to provide a predetermined gap between the anilox roller and the fountain roller;

adjusting a position of the pivotable ink pan by adjusting a height of a distal portion of the pivotable ink pan by a predetermined amount that is known to close the predetermined gap between the anilox roller and the fountain roller to a desired extent; and locking the position of the pivotable ink pan such that the distal portion of the pivotable ink pan is maintained at the adjusted height.

This invention has the advantage that the extent of contact between the anilox roller and the fountain roller can be controlled in an accurate and repeatable fashion. This will provide improved performance for the flexographic printing system. This is particularly important when the printing system is being used for applications such as printing grids of fine lines.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

Figure 1:
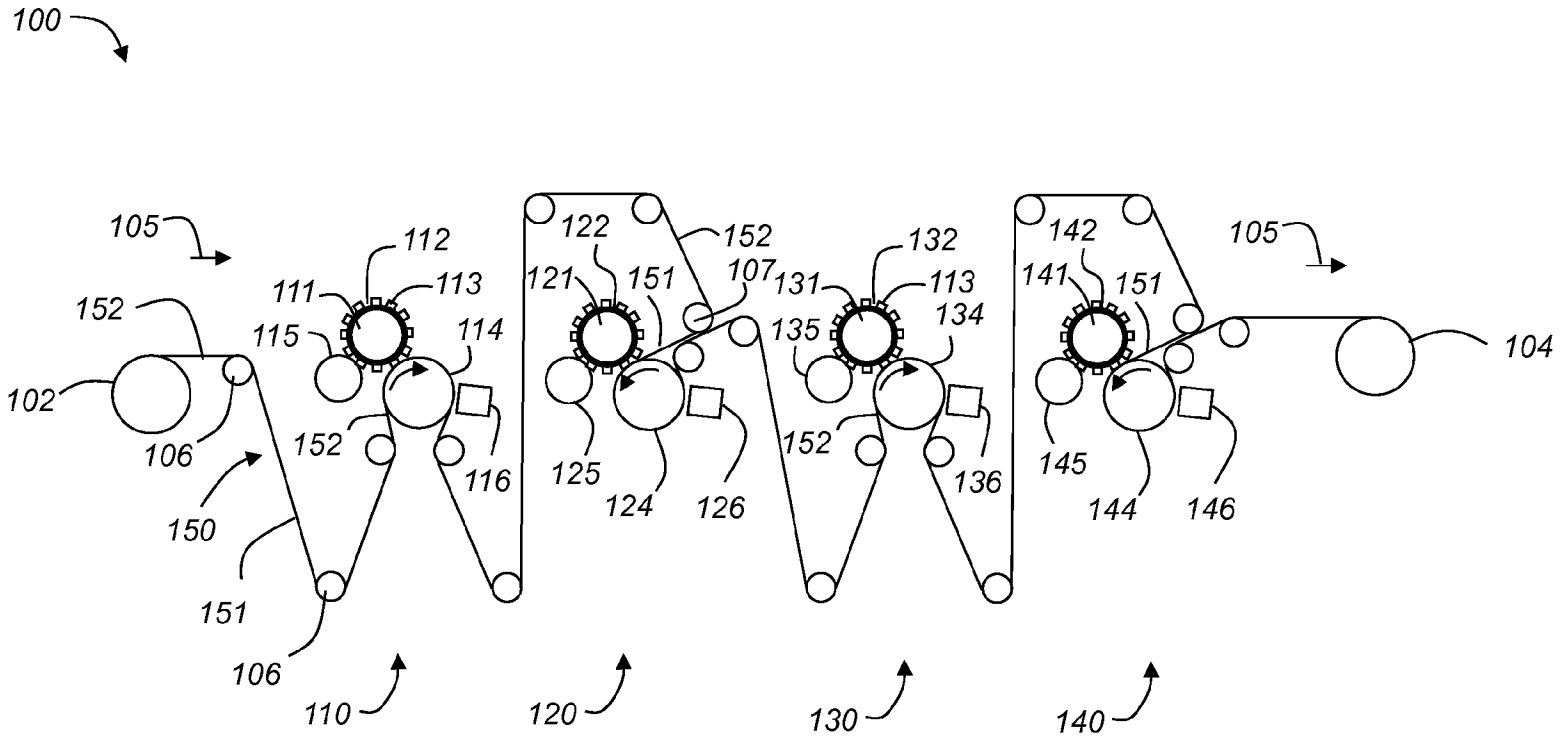
FIG. 1 is a schematic side view of a flexographic printing system for roll-to-roll printing on both sides of a substrate.

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. It should be noted that, unless otherwise explicitly noted or required by context, the word "or" is used in this disclosure in a non-exclusive sense.

The example embodiments of the present invention are illustrated schematically and not to scale for the sake of clarity. One of ordinary skill in the art will be able to readily determine the specific size and interconnections of the elements of the example embodiments of the present invention.

As described herein, the example embodiments of the present invention provide an inking system for use in a flexographic printing system, particularly for printing functional devices incorporated into touch screens. However, many other applications are emerging for printing of functional devices that can be incorporated into other electronic, communications, industrial, household, packaging and product identification systems (such as RFID) in addition to touch screens. Furthermore, flexographic printing is conventionally used for printing of images and it is contemplated that the inking systems described herein can also be advantageous for such printing applications.

FIG. 1 is a schematic side view of a flexographic printing system 100 that can be used in embodiments of the invention for roll-to-roll printing on both sides of a substrate 150. Substrate 150 is fed as a web from supply roll 102 to take-up roll 104 through flexographic printing system 100. Substrate 150 has a first side 151 and a second side 152.

The flexographic printing system 100 includes two print modules 120 and 140 that are configured to print on the first side 151 of substrate 150, as well as two print modules 110 and 130 that are configured to print on the second side 152 of substrate 150. The web of substrate 150 travels overall in roll-to-roll direction 105 (left-to-right in the example of FIG. 1). However, various rollers 106 and 107 are used to locally change the direction of the web of substrate as needed for adjusting web tension, providing a buffer, and reversing a side for printing. In particular, note that in print module 120 roller 107 serves to reverse the local direction of the web of substrate 150 so that it is moving substantially in a right-to-left direction.

Each of the print modules 110, 120, 130, 140 includes some similar components including a respective plate cylinder 111, 121, 131, 141, on which is mounted a respective flexographic printing plate 112, 122, 132, 142, respectively. Each flexographic printing plate 112, 122, 132, 142 has raised features 113 defining an image pattern to be printed on the substrate 150. Each print module 110, 120, 130, 140 also includes a respective impression cylinder 114, 124, 134, 144 that is configured to force a side of the substrate 150 into contact with the corresponding flexographic printing plate 112, 122, 132, 142.

More will be said below about rotation directions of the different components of the print modules 110, 120, 130, 140, but for now it is sufficient to note that the impression cylinders 124 and 144 of print modules 120 and 140 (for printing on first side 151 of substrate 150) rotate counter-clockwise in the view shown in FIG. 1, while the impression cylinders 114 and 134 of print modules 110 and 130 (for printing on second side 152 of substrate 150) rotate clockwise in this view.

Each print module 110, 120, 130, 140 also includes a respective anilox roller 115, 125, 135, 145 for providing ink to the corresponding flexographic printing plate 112, 122, 132, 142. As is well known in the printing industry, an anilox roller is a hard cylinder, usually constructed of a steel or aluminum core, having an outer surface containing millions of very fine dimples, known as cells. How the ink is controllably transferred and distributed onto the anilox roller is described below. In some embodiments, some or all of the print modules 110, 120, 130, 140 also include respective UV curing stations 116, 126, 136, 146 for curing the printed ink on substrate 150.

Figure 2:
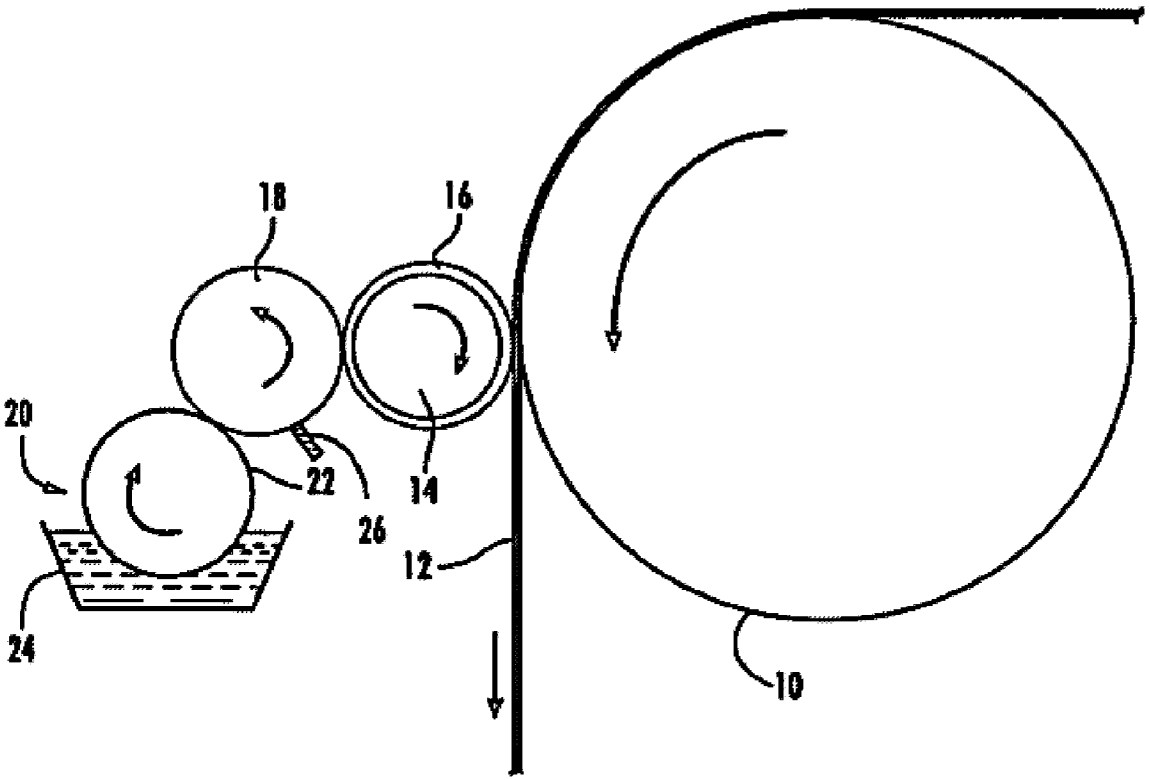
FIG. 2 (Prior Art)
FIG. 2 is a prior art flexographic printing apparatus using a fountain roller for ink delivery.
Figure 3:
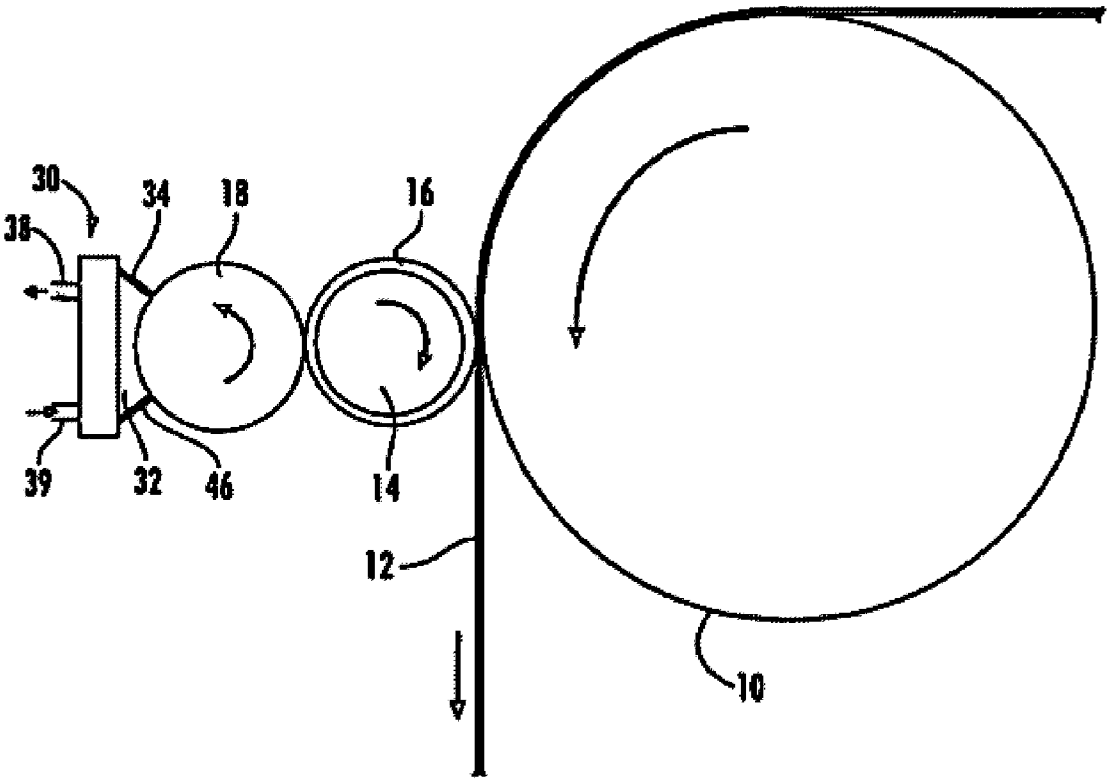
FIG. 3 (Prior Art)
FIG. 3 is a prior art flexographic printing apparatus using a reservoir chamber for ink delivery.

U.S. Pat. No. 7,487,724 to Evans et al. discloses inking systems for an anilox roller in a flexographic printing apparatus. FIG. 2 is a copy of Evans' FIG. 1 showing a flexographic printing apparatus using a fountain roller device 20 for delivering printing liquid (also called ink herein) to an anilox roller 18. FIG. 3 is a copy of Evans' FIG. 2 showing a reservoir chamber system 30 for delivering printing liquid to the anilox roller 18. The flexographic apparatuses shown in FIGS. 2 and 3 each comprises a rotatably driven impression cylinder 10 adapted to peripherally carry and transport a printable substrate 12, such as paper or a similar web-like material. A plate cylinder 14 is rotatably disposed adjacent the impression cylinder in axially parallel coextensive relation. The circumferential periphery of the plate cylinder 14 carries one or more flexible printing plates 16 formed with an image surface (not shown), for example in a relief image form, for peripherally contacting the circumferential surface of the impression cylinder 10 and the substrate 12 thereon. The anilox roller 18 is similarly disposed adjacent the plate cylinder 14 in axially parallel coextensive relation and in peripheral surface contact therewith.

The anilox roller 18 has its circumferential surface engraved with a multitude of recessed cells, which may be of various geometric configurations, adapted collectively to retain a quantity of printing liquid in a continuous film-like form over the circumferential surface of the anilox roller 18 for metered transfer of the liquid to the image surface on the printing plate 16 of the plate cylinder 14.

The flexographic printing apparatuses of FIGS. 2 and 3 differ principally in construction and operation in the form of delivery device provided for applying printing liquid to the anilox roller 18. In the FIG. 2 apparatus, the delivery device is in the form of a so-called fountain roller device 20, wherein a cylindrical fountain roller 22 is disposed in axially parallel coextensive relation with the anilox roller 18 in peripheral surface contact therewith, with a downward facing lower portion of the fountain roller 22 being partially submerged in a pan 24 containing a quantity of printing liquid. The fountain roller 22 rotates and constantly keeps the engraved cell structure of the circumferential surface of the anilox roller 18 filled with the printing liquid, thereby forming a thin film of the liquid as determined by the size, number, volume and configuration of the cells. A doctor blade 26 is preferably positioned in angled surface contact with the anilox roller 18 downstream of the location of its contact with the fountain roller 22, as viewed in the direction of rotation of the anilox roller 18, to progressively wipe excess printing liquid from the surface of the anilox roller 18, which drains back into the pan 24.

In contrast, the flexographic printing apparatus shown in FIG. 3 does not utilize a fountain roller, but instead uses a reservoir chamber 32 positioned directly adjacent the anilox roller 18, with forwardly and rearwardly inclined blades 34, 46 disposed in axially extending wiping contact with the surface of the anilox roller 18 at a circumferential spacing from each other. Blade 34 is upstream of the contact of the printing liquid from reservoir chamber 32 with anilox roller 18, and serves as a containment blade. Blade 46 is downstream of the contact of the printing liquid from reservoir chamber 32 with anilox roller 18, and serves as a doctor blade to wipe excess printing liquid from the surface of the anilox roller 18. Printing liquid is continuously delivered into the reservoir chamber 32 at ink entry 39 and is exhausted from the reservoir chamber 32 at ink exit 38 so as to maintain a slightly positive fluid pressure within the reservoir chamber 32. In this manner, the reservoir chamber system 30 serves to constantly wet the peripheral surface of the anilox roller 18.

U.S. Patent Application Publication 2012/0186470 to Marco et al. entitled "Printing device and method using energy-curable inks for a flexographic printer," discloses a flexographic printer adapted for printing an energy-curable printing ink containing components including resin, pigment and a non-reactive evaporable component such as water or another solvent. A reservoir chamber, such as reservoir chamber 32 mentioned above with reference to FIG. 3, having an ink supply line and an ink return line is used to apply ink to the anilox roller. A reading device, such as a viscometer, is used to characterize a ratio of the non-reactive evaporable component of the printing ink in the ink supply line to the reservoir chamber 32. A suitable amount of the non-reactive evaporable component is added to the ink based on the viscometer reading.

As disclosed in commonly-assigned, co-pending U.S. patent application Ser. No. 14/146,867 to Shifley, entitled "Inking system for flexographic printing," filed Jan. 3, 2014, which is incorporated herein by reference, it has been found that for printing of narrow lines with somewhat viscous inks, line quality is generally better when using an ink pan and a fountain roller to provide ink to the anilox roller than when using a reservoir chamber to deliver ink directly to the anilox roller. It is believed that the fountain roller is more effective in forcing viscous inks into the cells on the surface of the anilox roller than is mere contact of ink at an ink delivery portion of a reservoir chamber.

Figure 4:
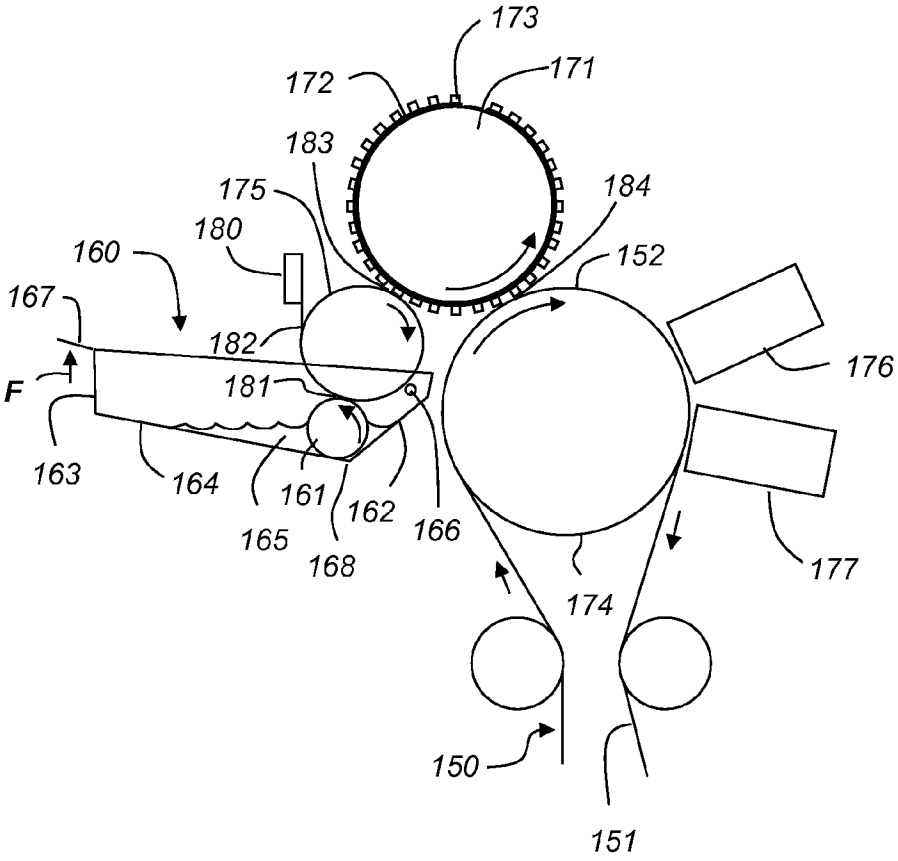
FIG. 4 is a schematic side view of an inking system using a pivotable ink pan with a fountain roller in contact with the anilox roller for a first roller rotation direction.

FIG. 4 shows a close-up side view of an ink pan 160 with a fountain roller 161 for use in flexographic printing systems for providing ink to anilox roller 175. In this embodiment, the configuration and rotation directions of impression cylinder 174, plate cylinder 171 and anilox roller 175 are similar to the corresponding impression cylinder 114, plate cylinder 111 and anilox roller 115 in print module 110 of FIG. 1.

Ink pan 160 includes a front wall 162 located nearer to impression cylinder 174, a rear wall 163 located opposite front wall 162 and further away from impression cylinder 174, and a floor 164 extending between the front wall 162 and the rear wall 163. The ink pan 160 also includes two side walls (not shown in FIG. 4) that extend between the front wall 162 and the rear wall 163 on opposite sides of the ink pan 160 and intersect the floor 164. It should be noted that there may or may not be distinct boundaries between the front wall 162, the rear wall 163, the floor 164 and the side walls. In some embodiments, some or all of the boundaries between these surfaces can be joined using rounded boundaries that smoothly transition from one surface to the adjoining surface.

Fountain roller 161 is partially immersed in an ink 165 contained in ink pan 160. Within the context of the present invention, the ink 165 can be any type of marking material, visible or invisible, to be deposited by the flexographic printing system 100 (FIG. 1) on the substrate 150. Fountain roller 161 is rotatably mounted on ink pan 160. Ink pan 160 is pivotable about pivot axis 166, preferably located near the front wall 162.

A lip 167 extends from rear wall 163. When an upward force F is applied to lip 167 as in FIG. 4, ink pan 160 pivots upward about pivot axis 166 until fountain roller 161 contacts anilox roller 175 at contact point 181. In the upwardly pivoted ink pan 160 the floor 164 tilts downward from rear wall 163 toward the front wall 162 so that fountain roller 161 is located near a lowest portion 168 of floor 164. If upward force F is removed from lip 167, ink pan 160 pivots downward under the influence of gravity so that fountain roller 161 is no longer in contact with anilox roller 175.

As described with reference to FIG. 1, a flexographic printing plate 172 (also sometimes called a flexographic master) is mounted on plate cylinder 171. In FIG. 4, flexographic printing plate 172 is a flexible plate that is wrapped almost entirely around plate cylinder 171. Anilox roller 175 contacts raised features 173 on the flexographic printing plate 172 at contact point 183. As plate cylinder 171 rotates counter-clockwise (in the view shown in FIG. 4), both the anilox roller 175 and the impression cylinder 174 rotate clockwise, while the fountain roller 161 rotates counter-clockwise. Ink 165 that is transferred from the fountain roller 161 to the anilox roller 175 is transferred to the raised features 173 of the flexographic printing plate 172 and from there to second side 152 of substrate 150 that is pressed against flexographic printing plate 172 by impression cylinder 174 at contact point 184.

In order to remove excess amounts of ink 165 from the patterned surface of anilox roller 175 a doctor blade 180, which is mounted to the frame (not shown) of the printing system, contacts anilox roller 175 at contact point 182. Contact point 182 is downstream of contact point 181 and is upstream of contact point 183. For the configuration shown in FIG. 4, in order to position doctor blade 180 to contact the anilox roller 175 downstream of contact point 181 where the fountain roller 161 contacts the anilox roller 175, as well as upstream of contact point 183 where the anilox roller 175 contacts the raised features 173 on the flexographic printing plate 172, doctor blade 180 is mounted on the printer system frame on a side of the anilox roller 175 that is opposite to the impression cylinder 174.

After printing of ink on the substrate, it is cured using UV curing station 176. In some embodiments, an imaging system 177 can be used to monitor line quality of the pattern printed on the substrate.

The configuration of the pivotable ink pan 160 with the doctor blade 180 located on the side of the anilox roller 175 that is opposite to the impression cylinder 174, as shown in FIG. 4, is compatible for the rotation directions of the rollers that are as shown in print modules 110 and 130 of FIG. 1 for printing on second side 152 of substrate 150. In such configurations (with reference to FIG. 4), the side of anilox roller 175 that moves upward toward plate cylinder 171 after receiving ink 165 from fountain roller 161 is the side that is located farther away from the front wall 162 of ink pan 160, and also farther away from impression cylinder 174. Comparing FIG. 1 with FIG. 4 it can be appreciated that for print modules 120 and 140, where the rotation directions of the impression cylinders 124 and 144 are opposite the rotation directions of the impression cylinders 114 and 134 in print modules 110 and 130, the side of the corresponding anilox rollers 125 and 145 that would move upward from the ink pans 160 (not shown in FIG. 1) toward the plate cylinders 121 and 141 would be the side that is next to the front wall 162 of ink pan 160. In some flexographic printing systems, spatial constraints due to the proximity of the impression cylinder 174 to the near side of the anilox roller 175 limit where a doctor blade could be positioned on that side of the anilox roller 175. (By contrast, the more spread-out prior art configuration shown in FIG. 2 does not have such spatial constraints, so that the doctor blade 26 can be located on that side of anilox roller 18.)

Figure 5:
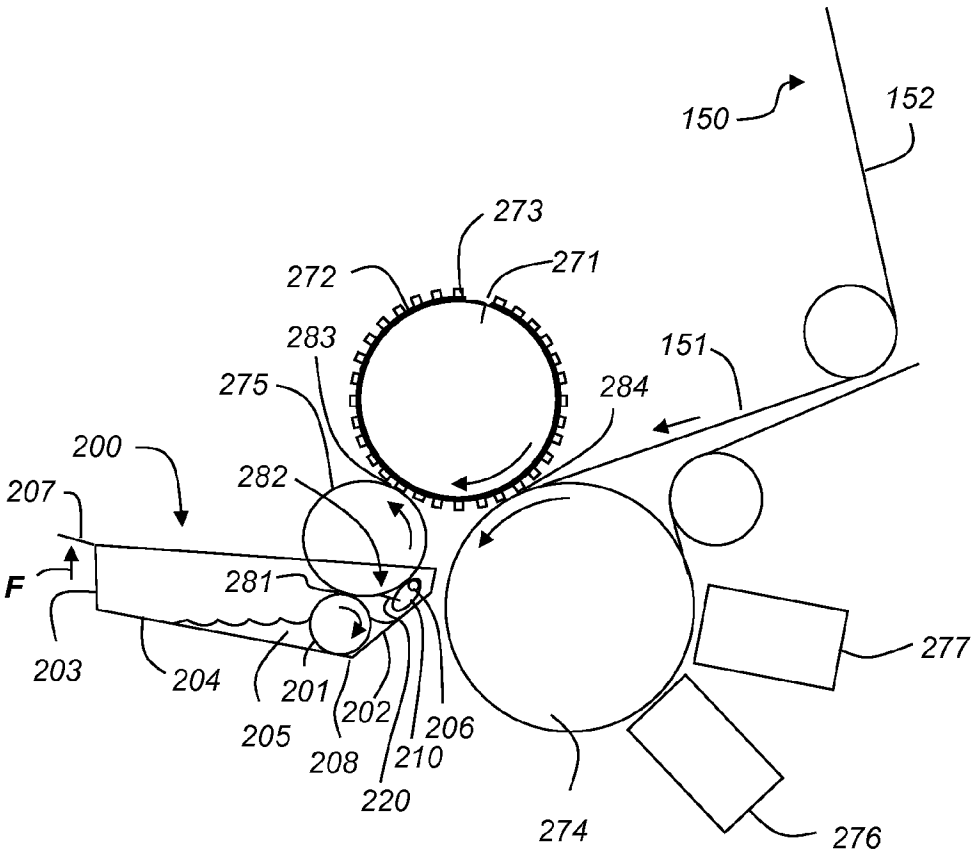
FIG. 5 is a schematic side view of an inking system using a pivotable ink pan with a fountain roller in contact with the anilox roller for a second roller rotation direction.

A close-up schematic side view of an inking system for flexographic printing using viscous inks for print modules having tight spatial constraints around the anilox roller when printing on a side of the substrate requiring that the side of the anilox roller that faces the impression cylinder moves upward is shown in FIG. 5. The configuration shown in FIG. 5 can be used, for example, for print modules 120 and 140 in FIG. 1 where the web of substrate 150 reverses direction for printing on first side 151, such that a direction of rotation of impression cylinder 274 causes a surface of the impression cylinder 274 to move in a downward direction on a side of the impression cylinder 274 facing front wall 202 of ink pan 200. In the configuration of FIG. 5, pivotable ink pan 200 with fountain roller 201 positioned in proximity to lowest floor portion 208 of floor 204 of ink pan 200 is used to transfer ink 205 to anilox roller 275 at contact point 281. Ink 205 is transferred to raised features 273 of flexographic printing plate 272 on plate cylinder 271 at contact point 283 and is subsequently printed onto first side 151 of substrate 150, being pressed into contact by impression cylinder 274 at contact point 284. As in FIG. 4, a force F can be applied to lip 207 on rear wall 203 of the ink pan 200 to pivot the ink pan 200 around the pivot axis 206, bringing the fountain roller 201 into contact with the anilox roller 275. UV curing station 276 is optionally provided for curing the printed ink on first side 151 of substrate 150. Imaging system 277 is provided for monitoring the line quality of the lines printed on the substrate 150.

As disclosed in commonly-assigned, co-pending U.S. patent application Ser. No. 14/146,867, fitting doctor blade 220 within the tight spatial constraints downstream of contact point 281 and upstream of contact point 283 (where anilox roller 275 transfers ink 205 to raised features 273 of flexographic printing plate 272) can be addressed by mounting the doctor blade 220 to the ink pan 200 on the side of the anilox roller 275 that is nearest to the impression cylinder 274. In particular, doctor blade 220 can be mounted within ink pan 200 using a blade holder 210 positioned near the front wall 202 of the ink pan 200 such that the doctor blade 220 contacts the anilox roller 275 at contact point 282.

It has recently been found that it is difficult to maintain tight tolerances (plus or minus one micron for example) on line width of narrow lines as the ink increases in viscosity due to evaporation of solvent in the ink. Although ink recirculation and solvent replenishment for a reservoir chamber have previously been disclosed in U.S. Patent Application Publication No. 2012/0186470 as described above, ink replenishment in an ink pan for a flexographic printing system is typically done by pouring additional ink into the ink tank. The newly added ink does not always mix well with the residual ink that is still in the ink pan. Such incomplete mixing can result in ink viscosity variation within the ink pan, giving rise to excessive variation in line width and quality of the printed narrow lines.

Commonly-assigned, co-pending U.S. patent application Ser. No. 14/162,807 to Shifley et al., entitled "Flexographic printing system with solvent replenishment", filed Jan. 24, 2014, which is incorporated herein by reference, discloses a solvent replenishment system for inks in a flexographic printing system. Although that system works well, in some cases it has been found that more precise control of the timing and rate of solvent replenishment is desirable.

Figure 6:
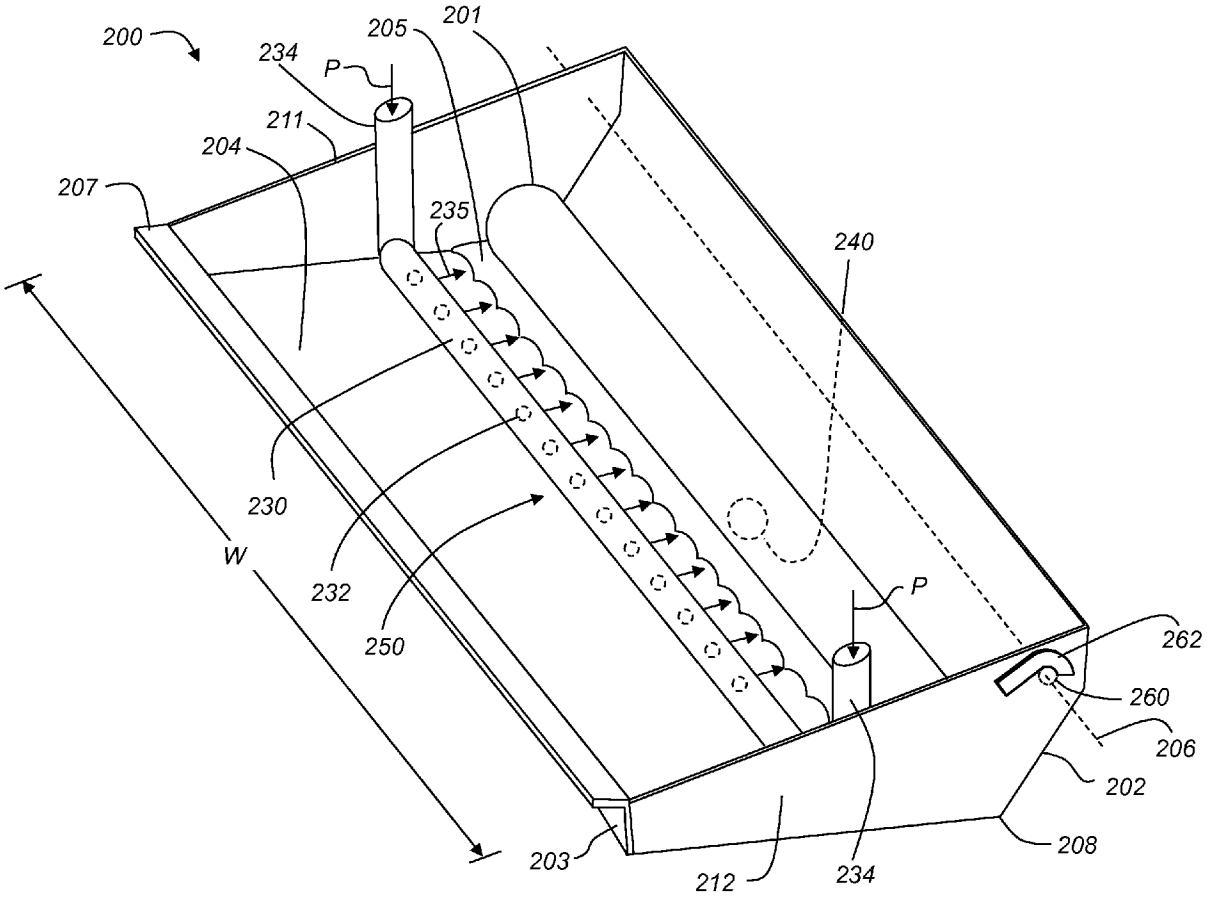
FIG. 6 is a top perspective of an ink pan for ink recirculation that can be used with embodiments of the invention.
Figure 8:
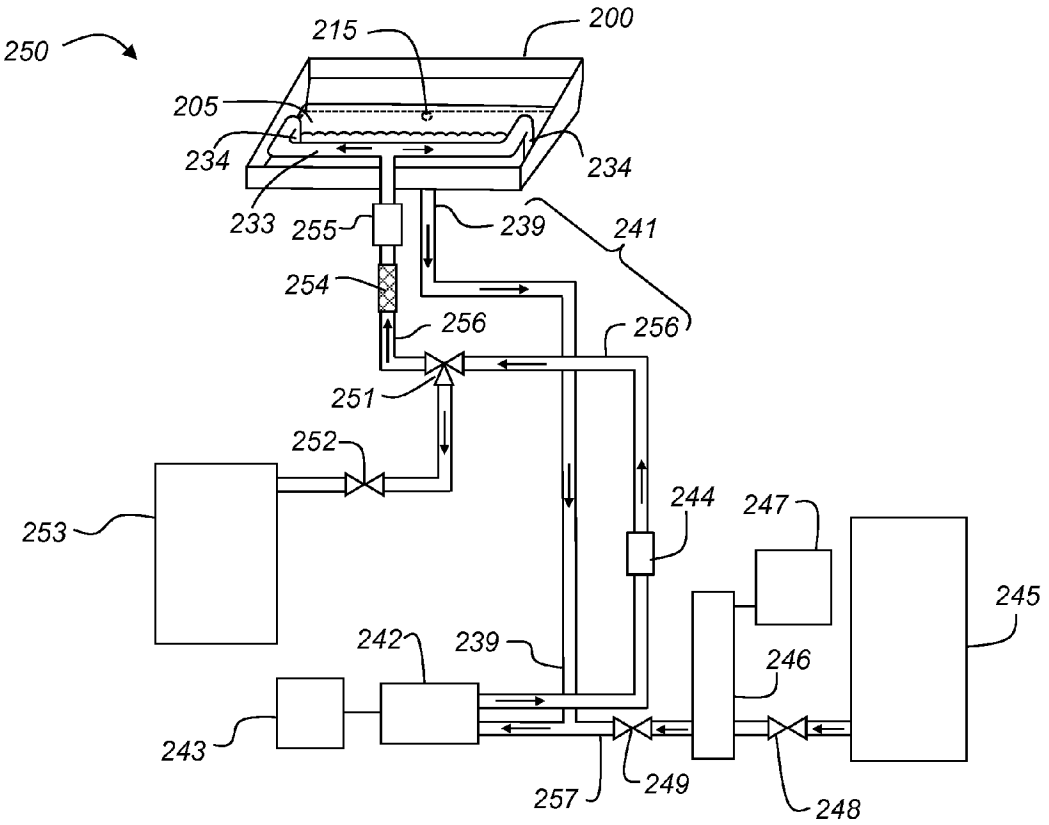
FIG. 8 is a schematic of an ink recirculation and solvent replenishment system that can be used with embodiments of the invention.

FIG. 6 shows a top perspective of an ink pan 200 for use with an ink recirculation system 250 (see FIG. 8). FIG. 6 does not show the configuration of the doctor blade as the ink recirculation system 250 of the invention is applicable to both the ink pan 160 of FIG. 4 and the ink pan 200 of FIG. 5. (In other words, the numbering of ink pan 200 in FIG. 6 is meant to be exemplary rather than exclusively referring to the inking system of FIG. 5.) First side wall 211 and its opposing second side wall 212 are shown in this perspective as extending between the front wall 202 and the rear wall 203 and intersecting the floor 204. A width W of ink pan 200 is defined by first and second side walls 211 and 212.

Some components of ink recirculation system 250 are shown in FIG. 6. In particular, an ink recirculation port 240 is disposed near the center of the width W of ink pan 200 near front wall 202 and near a lowest floor portion 208 of the floor 204 of the ink pan 200. Ink recirculation port 240 is hidden behind fountain roller 201 in FIG. 6 and extends below ink pan 200, but the opening 215 of ink recirculation port 240 is shown covered by ink 205 in the perspective of FIG. 7, where the fountain roller 201 has been removed for clarity. In some embodiments (not shown) there is a plurality of ink recirculation ports in proximity to the lowest floor portion 208 of the floor 204 of the ink pan 200.

Figure 7:
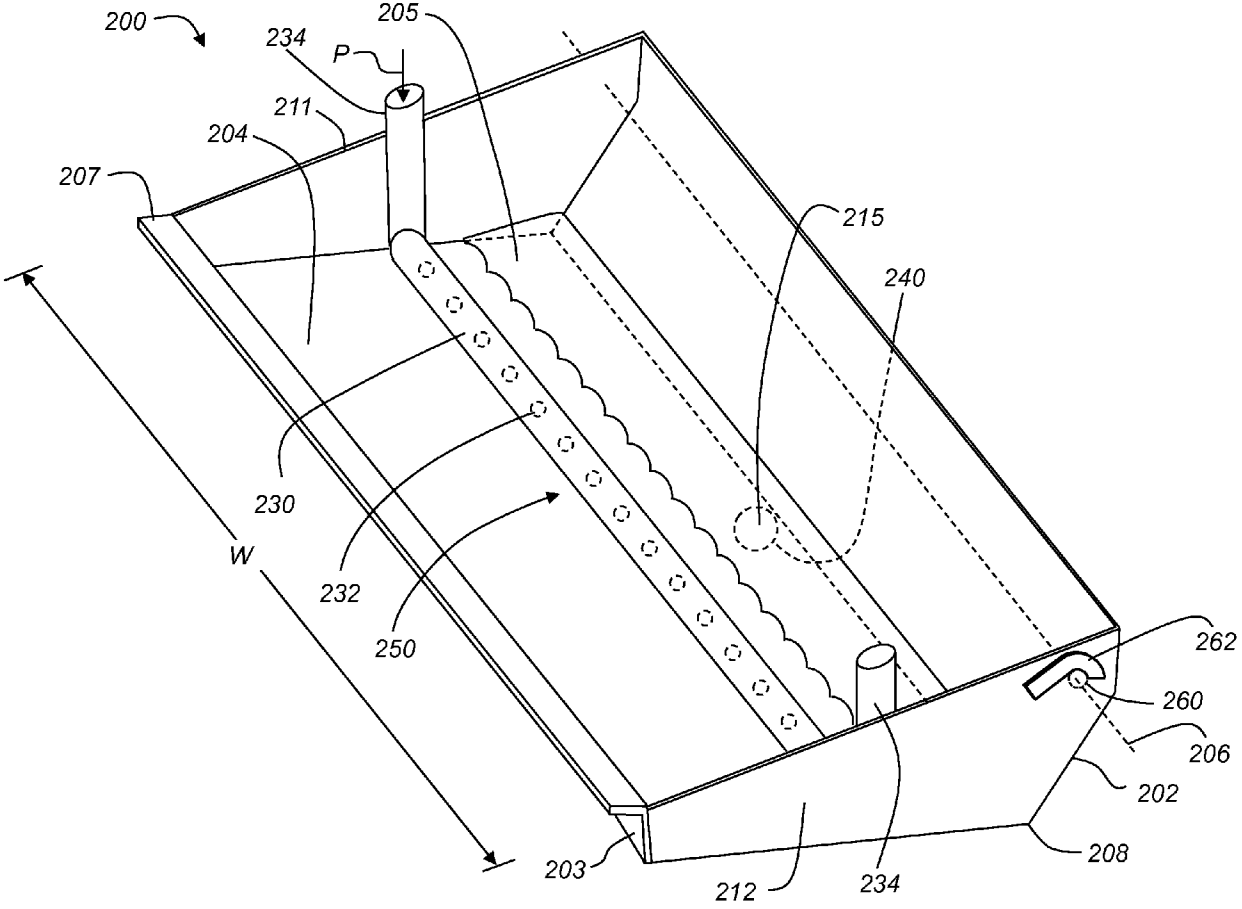
FIG. 7 is similar to FIG. 6, but with the fountain roller removed.

Ink 205 is drawn out of the ink pan 200 through the ink recirculation port 240 as described in further detail below. Solvent replenished ink is returned to the ink pan 200 via ink distribution tube 230. Ink distribution tube 230 can have a cylindrical geometry as shown in FIGS. 6 and 7, or alternatively can have other configurations. Ink distribution tube 230 includes a plurality of ink supply ports 232 at a plurality of spaced apart locations across the width W of the ink pan 200. Ink distribution tube 230 is preferably substantially parallel (i.e., within about 20 degrees of parallel) to a rotation axis of fountain roller 201. In a preferred embodiment, pressure P is applied to both ends of ink distribution tube 230 using pressurized lines 234. In the example shown in FIGS. 6 and 7, ink supply ports 232 are disposed along a bottom of ink distribution tube 230 aimed toward floor 204, although this is not a requirement. In some embodiments, ink supply ports 232 can be equally spaced and have equal cross-sectional areas as shown. The replenished ink flows downward toward ink 205 along replenished ink entry paths 235.

It is generally a desirable feature for the ink pan 200 to be removable from the flexographic printing system 100 (FIG. 1), for example to facilitate cleaning. To facilitate this, one approach that can be used is to affix brackets 262 onto the first and second side walls 211, 212 of the ink pan 200. The brackets 262 are adapted to rest on pivot elements 260 mounted on a frame of the flexographic printing system 100. The brackets 262 support at least a portion of the weight of the ink pan 200, and together with the pivot elements 260 define the pivot axis 206 around which the ink pan 200 is adapted to pivot. In the illustrated embodiment, the bracket 262 makes contact with an outer surface of the pivot element 260 along an arc that includes an upper part of the pivot element 260. To remove the ink pan 200, it can be tilted around the pivot axis 206 to move the fountain roller 201 away from the anilox roller 275 (FIG. 5). The ink pan 200 can then be lifted to disengage the bracket 262 from the pivot element 260 so that the ink pan 200 can be removed.

FIG. 8 shows a schematic of the ink recirculation system 250 according to an embodiment of the invention. Direction of ink flow is indicated by the straight arrows. The fountain roller 201 (FIG. 6) is hidden in this figure in order to show opening 215 of the ink recirculation port more clearly. Furthermore, the ink distribution tube 230 (FIG. 6) is not visible in the perspective of FIG. 8.

Ink 205 exits ink pan 200 via ink drain line 239 due to the pumping action of ink recirculation pump 242, and optionally assisted by gravity. In some embodiments the ink recirculation pump 242 is a peristaltic pump. Action of ink recirculation pump 242 is controlled by control system 243. Ink is then moved back toward ink pan 200 via ink return line 256. Collectively, the ink drain line 239 and the ink return line 256 are referred to as ink recirculation line 241. The ink drain line 239 is on the low pressure side of ink recirculation pump 242, while ink return line 256 is on the high pressure side.

Over the course of time as ink 205 circulates through the ink recirculation system 250, particulates can enter the ink 205. This can include airborne particulates landing in ink pan 200, or particles being generated in other parts of the system. In some embodiments, a filter 244 is provided in the ink recirculation line 241 in order to remove particles that otherwise could degrade the quality of the printed pattern. For printing a touch screen sensor pattern having fine lines with widths between 4 microns and 8 microns, an inline filter 244 designed to remove particles larger than 1 micron or 2 microns, for example, can be provided in ink recirculation line 241. Typically, because of the pressure drop that occurs across filter 244, it is preferable for it to be located in the ink return line 256 on the high pressure side of the ink recirculation pump 242.

The ink recirculation system 250 is used to recirculate the ink 205 while the flexographic printing system 100 (FIG. 1) is printing in order to maintain the printing properties of ink 205 to be substantially consistent. This provides reduced variability in the performance of the flexographic printing system 100. In order to maintain the consistent printing properties of the ink 205 such that actual printed feature sizes are equal to the desired printed feature sizes within the required tolerances, it is necessary to maintain the solvent in the ink 205 at an appropriate concentration. It is therefore necessary to replenish the solvent in the ink 205 as it evaporates during operation of the flexographic printing system 100. To replenish the solvent, solvent from a solvent replenishment chamber 245 is pumped by metering pump 246 into solvent replenishment line 257 and enters ink recirculation pump 242 together with ink 205 from ink drain line 239. Valve 249 can be used to isolate metering pump 246 from the solvent replenishment line 257.

If the viscosity of the ink 205 is much higher than the viscosity of the solvent, it is found that simply pumping solvent into the ink 205 does not mix them to a sufficiently uniform extent. For example, a typical viscosity of an ink for functional printing of devices using a flexographic printing system will typically range between 10 centipoises and 20,000 centipoises, and in a preferred embodiment will be between about 40 centipoises and 2000 centipoises. By contrast, the viscosity of the solvent is typically between 0.3 and 3 centipoises. It is therefore advantageous to incorporate a mixing device 254 in the ink recirculation system 250 to provide sufficiently uniform solvent-replenished ink. In the example shown in FIG. 8, mixing device 254 is provided inline with ink return line 256. Mixing device 254 can be a dynamic mixing device or a static inline mixing device.

A rate of flow of solvent into solvent replenishment line 257 is controlled by control system 247 for metering pump 246. Metering pump 246 is a piston pump or a syringe pump, for example. The rate of flow can be controlled by an amount of solvent delivered per stroke, as well as the frequency of strokes of the metering pump 246. The preferred rate of flow is dependent on the evaporation rate of the solvent, which can depend on factors such as the volatility of the solvent, the temperature, and the surface area of exposed ink.

In some applications a closed loop system can be used in which properties of the ink 205 can be measured either continuously or on a sampled basis in order to control the replenishment of solvent. Commonly-assigned, co-pending U.S. patent application Ser. No. 14/296,513 to Shifley et al., entitled "Solvent replenishment using density sensor for flexographic printer", filed Jun. 5, 2014, which is incorporated herein by reference, discloses a solvent replenishment system including a density sensor 255 to characterize the ink and provide ink property information to control system 247 for controlling the rate of solvent flow. More specifically, control system 247 controls the flow rate of solvent provided by metering pump 246 based on a measured density of the ink 205 measured by density sensor 255. Herein when referring to a density sensor or ink density, what is meant is the volumetric mass density, typically expressed in grams per cubic centimeter (g/cc) or similar units.

Measuring the density of the ink to control the solvent concentration is particularly advantageous where the density of the solvent is significantly different from the remainder of the ink components without the solvent. The remainder of ink components excluding the solvent will be referred to herein as "solids." In a first example Dowanol™ PM glycol ether (available from the Dow Chemical Company) having a density of 0.92 g/cc at 20° C. was used as the solvent, and the solids had a density of 1.39 g/cc. In a second example again Dowanol™ PM glycol ether was used as the solvent and the solids had a density of 1.79 g/cc. In both of these examples the density of the solids is significantly different from the density of the solvent, so that as the solvent level changes there is a correspondingly change in the density that is significant and measurable with a high signal-to-noise ratio. A significant difference in density herein will be considered to be a density difference of at least 10%. It is more preferable to have a density difference of at least 30%, and still more preferable to have a density difference of 50% or more, as is the case for the two examples described above.

Any type of density sensor 255 known in the art can be used. One type of density sensor 255 that can be used to make highly precise density measurements of a fluid is an oscillating U-tube. This type of measurement was first demonstrated by Anton Parr GmbH, and density sensors 255 of this type are commercially available from Anton Parr GmbH. In such devices, a fluid is made to pass through a U-tube that is supported by bearing points and the U-tube is excited into resonance. The resonant frequency depends on the mass of the fluid contained in the known volume of the tube between the bearing points, so that the density of the fluid at any given time is related to the resonant frequency that is measured. As the solvent concentration changes, the density changes so that the frequency changes.

In an exemplary embodiment, the density of an ink 205 for flexographic printing was maintained within the tight specification of ±0.001 g/cc at a target value of density near 1.3 g/cc. The corresponding solvent weight percent was controlled to within ±0.1% at a target of approximately 35%. The measurement scheme for solvent replenishment control does not require the density measurement to be highly accurate, nor to provide an accurate measurement of the ink's solvent concentration. It only requires that the density measurement be highly precise (i.e., reproducible and repeatable) in order for the control system 247 to control the flow rate of the solvent provided by the metering pump 246 such that variations in the measured density of the ink 205 as a function of time are reduced relative to a target density.

Also shown in the ink recirculation system 250 of FIG. 8 is an ink recovery tank 253. In some applications, the ink 205 can be very expensive. When it is desired to purge the ink 205 from the printing system, the ink 205 in ink pan 200, as well as in ink recirculation line 241, can be pumped into the ink recovery tank 253. In an exemplary embodiment, a multi-position ink recovery valve 251 is provided downstream of the ink recirculation pump 242. When the ink recovery valve 251 is in a first position the ink is directed to pressure manifold 233, which allows ink to flow through the pressurized lines 234 at the ends of the ink distribution tube 230 (FIG. 6). The ink is then directed from both ends through the ink distribution tube 230 and out of the ink supply ports 232 (FIG. 6) into the ink pan 200. When the ink recovery valve 251 is in a second position, the ink is diverted into the ink recovery tank 253. Optionally, after the ink has been moved to the ink recovery tank 253, the ink recirculation system 250 can be solvent flushed for maintaining good flow through the various lines and orifices.

In some embodiments, it can be advantageous to provide independent control of flow rate of solvent for some or all of the various print modules 110, 120, 130, 140 of the flexographic printing system 100 (FIG. 1). In some instances this can be due to different types of ink and different volatility of solvent used for different print modules. In other instances the environmental conditions, such as temperature, can be different for different print modules. In still other instances, the dwell time of the ink on the flexographic printing plate can be different among different print modules, which leads to different amounts of evaporation of solvent prior to printing on substrate 150. In particular, consider the inking system shown in FIG. 4 that can be employed for print modules 110 and 130 (FIG. 1) for printing on second side 152 of substrate 150 as discussed above. After ink is transferred from anilox roller 175 to flexographic printing plate 172 at contact point 183, plate cylinder 171 only needs to rotate counterclockwise by about 60 degrees before the ink is printed on second side 152 of substrate 150 at contact point 184. In contrast, for the inking system shown in FIG. 5 that can be employed for print modules 120 and 140 (FIG. 1) for printing on first side 151 of substrate 150, after ink is transferred from anilox roller 275 to flexographic printing plate 272 at contact point 283, plate cylinder 271 needs to rotate clockwise by about 300 degrees before the ink is printed on first side 151 of substrate 150 at contact point 284. Thus the dwell time of the ink in a very thin layer on flexographic printing plate 272 (FIG. 5) is about 5 times as long as it is on flexographic printing plate 172 (FIG. 4). This can lead to a greater degree of solvent evaporation in print modules 120 and 140 after ink transfer to anilox roller 275 than in print modules 110 and 130 (FIG. 1). As a result, the control systems 247 for the metering pumps 246 in print modules 120 and 140 may need to provide a higher flow rate than the control systems 247 for the metering pumps 246 in print modules 110 and 130.

Figure 9:
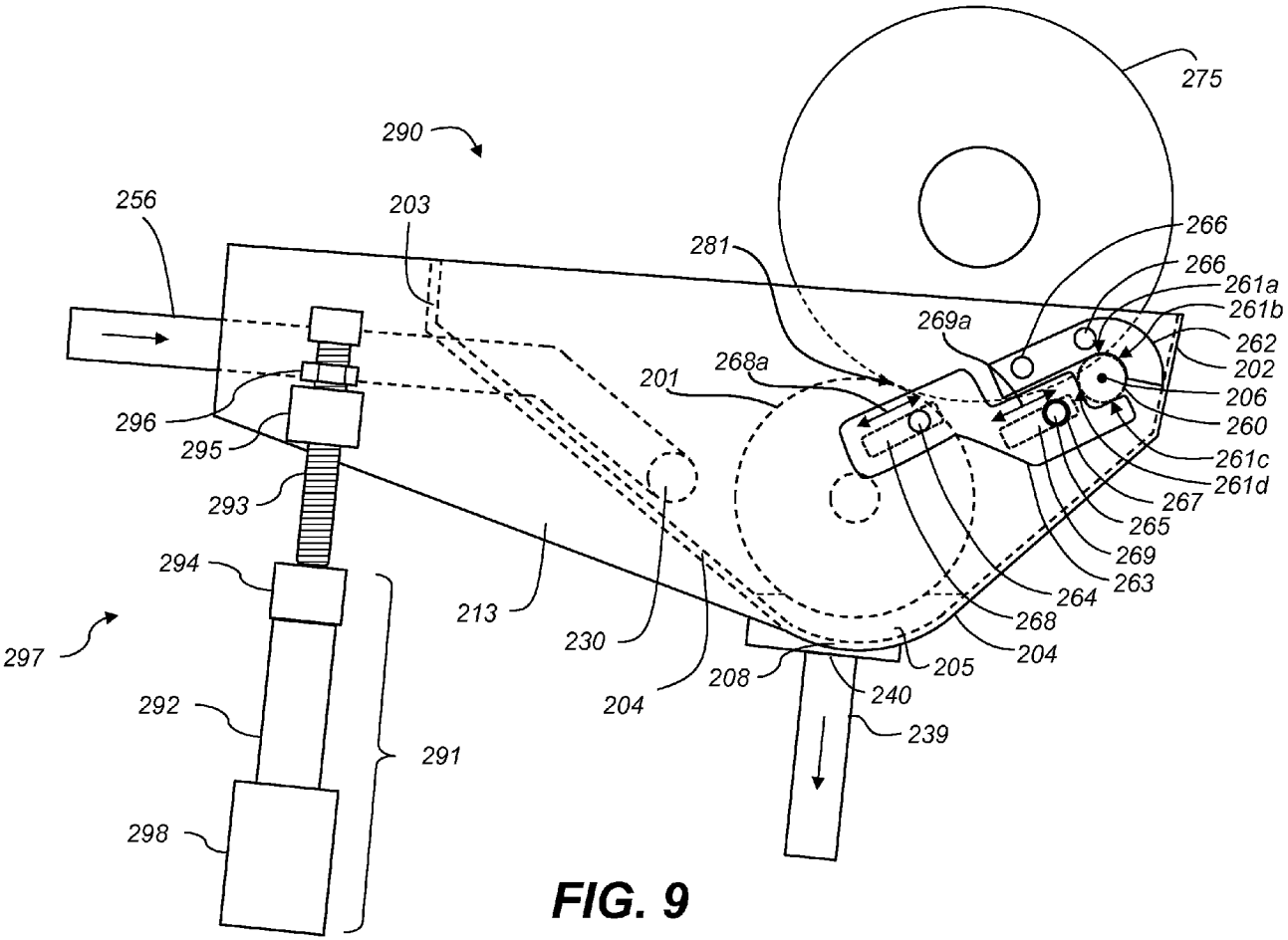
FIG. 9 is a schematic side view of a pivotable ink pan according to an exemplary embodiment.
Figure 10:
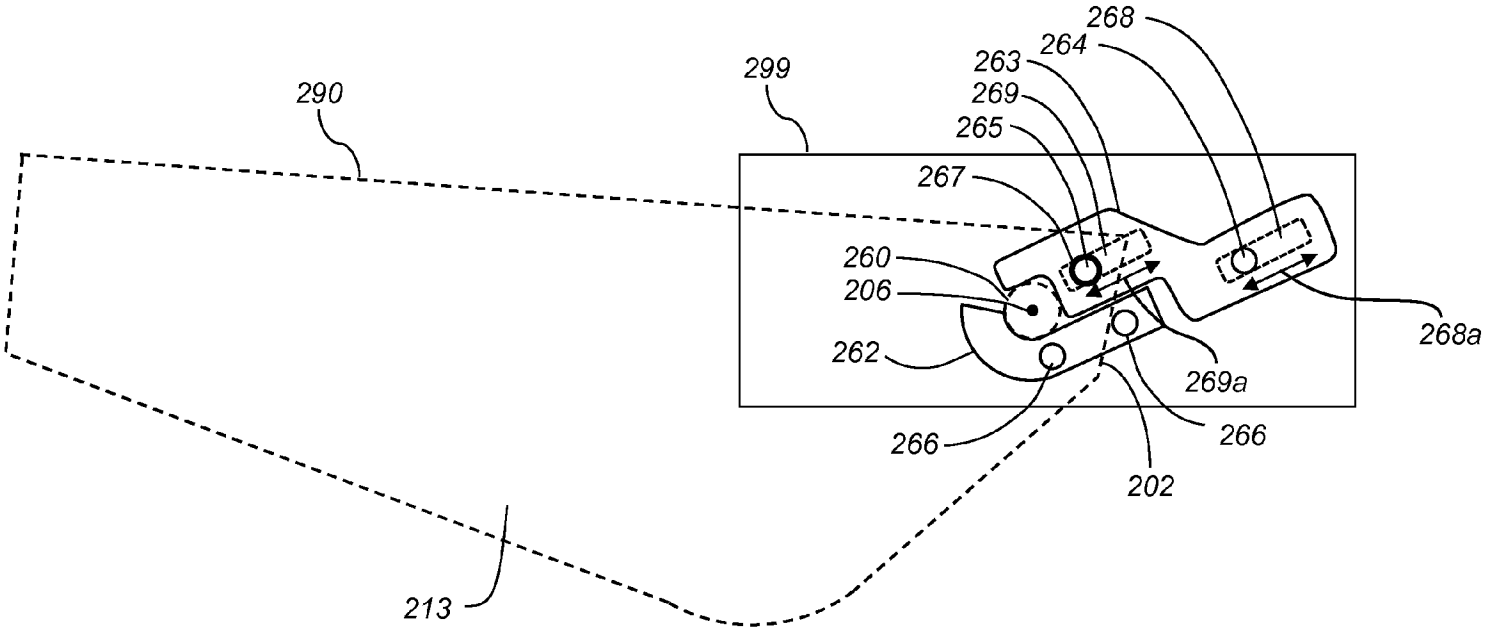
FIG. 10 is a schematic side view showing an alternate arrangement for mounting a pivotable ink pan.

To save on space and cost in the flexographic printing system 100 (FIG. 1), it can also be advantageous in some cases to share portions of ink recirculation system 250 among the different print modules 110, 120, 130 and 140 rather than duplicating all components in each print module. With reference also to FIGS. 8-10, two components that can be particularly useful to share among a plurality of print modules are the solvent replenishment chamber 245 and the ink recovery tank 253. In some embodiments, a valve 248 can be associated with the solvent replenishment chamber 245. In some configurations, the valve 248 can be a shut-off valve isolating solvent replenishment chamber 245. In other configurations, the valve 248 can be a multi-position valve allowing connection of the solvent replenishment chamber 245 to ink recirculation systems 250 for a plurality of print modules 110, 120, 130 and 140. Similarly, a valve 252 can be associated with the ink recovery tank 253. In some configurations, the valve 252 can be a multi-position valve allowing connection of ink recovery tank 253 to ink recirculation systems 250 for a plurality of print modules 110, 120, 130 and 140.

Commonly-assigned, co-pending U.S. patent application Ser. No. 14/524,247 to Shifley et al., filed Oct. 27, 2014, entitled "Flexographic ink recirculation with anti-air-entrainment features," which is incorporated herein by reference, describes improvements to the ink recirculation system to provide reduced introduction of air into the ink recirculation lines, which can result in the formation of printing defects. The features described in this patent application can be used in accordance with embodiments of the present invention.

In the configuration for the ink pan 200 described in FIGS. 6-7, the bracket 262 supports at least a portion of the weight of the ink pan 200. There will generally be lifting mechanism (not shown) to provide the upward force F (FIG. 5) to lift the rearward end of the ink pan 200 (i.e., the end toward rear wall 203), thereby bringing the fountain roller 201 into contact with the anilox roller 275 (FIG. 5) with a controlled amount of pressure. The lifting mechanism will also generally support at least a portion of the weight of the ink pan 200. This ink pan configuration relies on the weight of the ink pan 200 to keep the bracket 262 in tight contact with the pivot element, thereby constraining the ink pan 200 to pivot around the pivot axis 206. However, it has been found that the components of the ink recirculation system 250 discussed with respect to FIGS. 6-8 can apply forces to the ink pan 200 which can cause one or both of the brackets 262 to lift away from the pivot element 260. For example, the weight of the ink recirculation lines 241 and the ink return line 256 can provide forces and torques that can cause the ink pan 200 to shift out of its intended position. This can cause the magnitude and uniformity of the contact pressure between the fountain roller 201 and the anilox roller 275 to vary from the desired characteristics. This can affect the amount of ink transferred to the anilox roller 275, which will in turn adversely affect the performance of the flexographic printing system 100.

FIG. 9 illustrates an improved ink pan 290 according to an embodiment of the present invention. The ink pan 290 shares many similar features to the ink pan 200 of FIGS. 5-7, and includes front wall 202, rear wall 203 and floor 204. The ink pan 290 is adapted to pivot around pivot axis 206 disposed proximate to the front wall 202. The pivot axis 206 is defined by pivot element 260, which is mounted on an external component such as a frame of the flexographic printing system 100 (FIG. 1). Fountain roller 201 is mounted within the ink pan 290 in proximity to lowest floor portion 208 between extended side walls 213 and is at least partially immersed in the ink 205 in the ink pan 290. The fountain roller 201 is adapted to rotate to carry ink 205 to the anilox roller 275, which in turn applies a controlled amount of ink to the raised features 273 (FIG. 5) of the flexographic printing plate 272 (FIG. 5) on the plate cylinder 271 (FIG. 5) for printing on substrate 150 (FIG. 5).

A first bracket 262 is affixed to each side wall 213, and is configured to rest on the pivot element 260 for supporting at least a portion of the weight of the ink pan 290. The bracket 262 can be affixed to the side wall 213 using any method known in the art. In an exemplary configuration, the bracket 262 includes holes that are adapted to fit over alignment pins 266 formed onto the side wall 213. Once placed into position, the bracket 262 is tack welded to the side wall 213. In other embodiments, the bracket 262 can be affixed to the side wall using other fastening means such as screws, or can be formed as a component of the side wall 213.

A second bracket 263 is configured to be affixed to each side wall 213 of the ink pan 290 in an adjustable position. The second bracket 263 is configured to constrain motion of the ink pan 290 to a pivoting motion around the pivot axis 206. The position of the bracket 263 is adjustable such that it can slide laterally toward or away from the pivot element 260.

A clamping element is used to affix the bracket 263 to the ink pan 290 at a position where a portion of the bracket 263 maintains contact with the pivot element 260 during pivoting, thereby constraining the motion of the ink pan 290 to a pivoting motion around the pivot axis 206. In an exemplary embodiment, the clamping element is a clamping screw 264, which passes through a slot 268 formed in the side wall 213 of the ink pan 290 and is threaded into a threaded hole in the bracket 263. When the clamping screw 264 is tightened, the bracket 263 is tightly affixed to the side wall 213. When the clamping screw 264 is loosened, it is adapted to slide within the slot 268 along a slot direction, thereby enabling the position of the bracket 263 to slide laterally in the slot direction 268*a*.

In the illustrated configuration, a pin 265 extends through a second slot 269 in the side wall 213, and through a hole in the bracket 263 where it is held in place with a retaining ring 267 (e.g., a split ring). Alternatively, the pin 265 can be permanently affixed to the bracket 263. In the illustrated configuration, the slots 268, 269 are shown as being linear and with respective parallel slot directions 268*a*, 269*a*, however this is not a requirement. In other configurations, the slots 268, 269 may be curved, or may have non-parallel slot directions 268*a*, 269*a* so that the bracket 263 pivots as it is repositioned to bring it into contact with the pivot element 260. In the illustrated embodiment, the clamping screw 264 passes through the slot 268 which is distal to the pivot element 260 and the pin 265 passes through the slot 269 which is proximate to the pivot element 260. In other configurations these positions can be reversed, or clamping screws 264 can be used in both positions.

In the illustrated configuration, the first bracket 262 has an arced lower surface having a radius of curvature that matches the radius of the pivot element 260, so that the bracket 262 contacts the pivot element 260 along an arc that extends at least from an upper contact point 261*a* to a first side contact point 261*b* proximate to the front wall 202. In other configurations, the lower surface of the bracket 262 can have other shapes so that it only contacts the pivot element 260 at discrete contact points (e.g., upper contact point 261*a* and first side contact point 261*b*).

When the second bracket 263 is positioned to constrain motion of the ink pan 290 to a pivoting motion around the pivot axis 206, the bracket 263 makes contact with the pivot element 260 at one or more contact points. In the illustrated configuration, the bracket 263 makes contact with the pivot element 260 at a lower contact point 261*c* (opposite the upper contact point 261*a*) and a second side contact point 261*d* (distal to the front wall 202 and opposite the first side contact point 261*b*). In total, the first and second brackets 262, 263 together should contact the pivot element 260 at a sufficient number of contact points so that the motion of the ink pan 290 is constrained to a pivoting motion around the pivot axis 206. Generally this will require that the total number of contact points be three or more.

When the clamping screw 264 is loosened and second bracket 263 is slid out of contact with the pivot element 260, the ink pan 290 is adapted to be removable from the flexographic printing system 100. In an exemplary embodiment, the ink pan 290 is removed by pivoting the ink pan 290 around the pivot axis 206 to lower the rear end of the ink pan (i.e., the end proximate the rear wall 203) to move the fountain roller 201 away from the anilox roller 275. The ink pan 290 can then be lifted off the pivot element 260 and pulled in rearward direction to remove the ink pan 290 from the flexographic printing system 100. This process can be reversed to reinstall the ink pan 290.

A height adjustment mechanism 297 is provided for adjusting a height of a portion of the ink pan 290 that is distal to the pivot axis 206 (i.e., the rearward end proximate the rear wall 203). In a preferred embodiment, two height adjustment mechanisms 297 are provided, one on each side of the ink pan 290. Only one height adjustment mechanism 297 is visible in FIG. 9 for controlling the height of the near side (sometimes called the "operator side") of the ink pan 290. An analogous height adjustment mechanism 297 is not visible in this view, which would be used for controlling the height of the far side (sometimes called the "gear side") of the ink pan 290.

In an exemplary configuration, the height adjustment mechanism 297 includes a pneumatic adjustment mechanism 291 that can be used to make large adjustments in the height of the distal portion of the ink pan 290, as well as an adjustment screw 293 that can be used to make fine adjustments. In the illustrated configuration, the pneumatic adjustment mechanism 291 includes a piston 292 extending from cylinder 298, whose height can be adjusted using control means well known in the art. In other configurations, a hydraulic adjustment mechanism or any other type of height adjustment mechanism known in the art can be used in place of the pneumatic adjustment mechanism 291.

The adjustment screw 293 threads through a threaded hole in a block 295 affixed (directly or indirectly) to the ink pan 290. The adjustment screw 293 is adapted to push against a block 294 mounted onto the piston, thereby adjusting the height of the distal end of the ink pan 290 up or down as the adjustment screw 293 is turned clockwise or counter-clockwise. In some arrangements, the adjustment screw 293 is adapted to be turned manually using a tool such as a wrench or a screwdriver. In other arrangements, an automatic mechanism (e.g., a computer-controlled stepper motor) can be used to turn the adjustment screw 293. The adjustment screw 293 has a predetermined thread pitch such that the height can be adjusted by a predetermined amount by turning the adjustment screw 293 a predetermined angle in a predetermined direction. A lock nut 296 is also provided which can be tightened to lock the adjustment screw 293 into position to maintain the ink pan 290 in a fixed position after the height has been adjusted to a desired operating position. In other configurations, any other type of locking mechanism known in the art can be used to lock the ink pan 290 into a fixed position.

A number of components of the ink recirculation system 250 (FIG. 8) are also shown in FIG. 9. In particular, an ink drain line 239 is shown for drawing ink 205 out of the ink pan 290 through the ink recirculation port 240. Recirculated ink 205 is returned into the ink pan 290 through ink return line 256 and ink distribution tube 230. The components of the ink recirculation system were discussed in more detail with respect to FIGS. 6-8.

As discussed earlier, the components of the ink recirculation system 250 can apply forces and torques to the ink pan 290. The arrangement of brackets 262, 263 in the configuration of FIG. 9 provide additional constraints on the ink pan 290 relative to the ink pan 200 of FIG. 6. This greatly reduces any potential for the position of the ink pan 290 to move to an unintended position, thereby significantly improving the reliability and consistency of the performance of the flexographic printing system 100 (FIG. 1).

In order to enable transferring a controllable amount of ink to the flexographic printing plate 272 (FIG. 5), it is important to be able to control an extent of contact at the contact point 281 between the fountain roller 201 and the anilox roller 275. Within the context of the present disclosure, the term "extent of contact" relates to how firmly the rollers are pressed together. It could be measured in a variety of different ways such as the contact pressure or nip width. One way to control the amount of contact is to use the height adjustment mechanism 297 to adjust the contact pressure to a predefined level. However, it has been found in some situations that the contact pressure is not always a good predictor of the extent of contact, and as a result that the amount of ink 205 transferred to the anilox roller 275 can vary, thereby affecting the performance of the flexographic printing system 100 (FIG. 1).

In the configuration of FIG. 9, the brackets 262, 263 are affixed to the side wall 213 of the pivotable ink pan 290, and the pivot element 260 is affixed to an external component, such as a frame of the flexographic printing system 100 (FIG. 1). FIG. 10 illustrates an alternate configuration where the mounting components are reversed. In this case, the brackets 262, 263 are affixed to a frame 299 of the flexographic printing system 100 and the pivot element 260 is affixed to the side wall 213 of the ink pan 290, proximate to the front wall 202. For clarity, other elements of the ink pan 290 are not shown in FIG. 10, but will be analogous to those shown in FIG. 9.

In the illustrated configuration, the positions of the fixed bracket 262 and the adjustable bracket 263 are reversed relative to FIG. 9 such that bracket 262 is below the pivot element 260 and bracket 263 is above the pivot element 260. The pivot element 260 is configured to rest on the bracket 262 to support at least a portion of the weight of the ink pan 290.

The adjustable bracket 263 is configured to be affixed to the frame 299 in an adjustable position, and is adapted to constrain the motion of the ink pan 290 to a pivoting motion around the pivot axis 206. Clamping screw 264 passes through slot 268, which in this configuration is formed into the frame 299, and threads into a threaded hole in the bracket 263. Similarly, pin 265 passes through slot 269 formed into the frame 299, and is affixed to the bracket 263 (e.g., using a retaining ring 267). The position of the bracket 263 is adjustable such that it can slide laterally toward or away from the pivot element 260. As in the configuration of FIG. 9, the bracket 263 can be adjusted by loosening the clamping screw 264 and sliding the clamping screw 264 and the pin 265 within respective slots 268, 269 having slot directions 268*a*, 269*a*.

With the configuration of FIG. 10, the ink pan 290 can be removed by loosening the clamping screw 264 and sliding the bracket 263 away from the pivot element 260. The distal end of the ink pan 290 can then be lowered using the height adjustment mechanism 297 to move the fountain roller 201 out of contact with the anilox roller 275 as was described relative to the discussion of FIG. 9. The ink pan 290 can then be lifted so that the pivot element 260 lifts off the bracket 262, and the ink pan 290 can then pulled in a rearward direction to remove it from the flexographic printing system 100 (e.g., to be cleaned).

Figure 11:
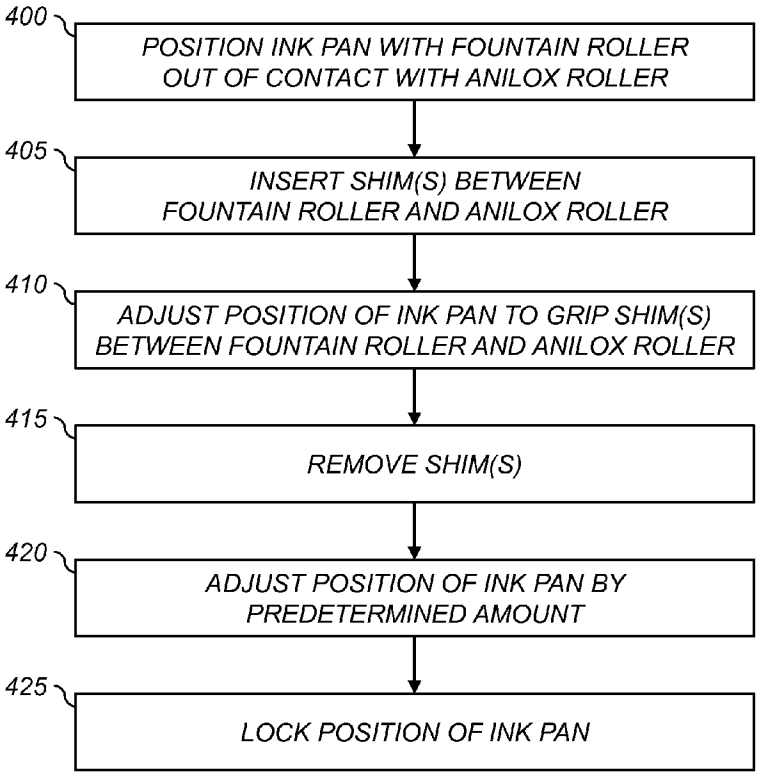
FIG. 11 is a flowchart illustrating a method for adjusting the pivotable ink pan of FIG. 9 to control the extent of contact between the fountain roller and the anilox roller.

FIG. 11 is a flow chart illustrating a method for adjusting the pivotable ink pan 290 of FIG. 9 to control the extent of contact between the fountain roller 201 and the anilox roller 275. (Note that this same method could also be used to adjust other types of ink pans such as the ink pan 200 of FIG. 6.)

First a position ink pan step 400 is used to position the ink pan 290 in an initial position where the fountain roller 201 is out of contact with the anilox roller 275. If the ink pan 290 has not already been installed into the flexographic printing system 100 (FIG. 1), the position ink pan step 400 can include installing the ink pan 290 and positioning the brackets 263 to constrain the motion of the ink pan 290 to a pivoting motion around the pivot axis 206 as was described earlier. In an exemplary arrangement, the height adjustment mechanism 297 is adjusted to make a coarse adjustment in the position of the ink pan 290. For example, this can be done by using the pneumatic adjustment mechanism 291 to extend the pistons 292 to a predetermined position. (At the predetermined position, there should still be a gap between the fountain roller 201 and the anilox roller 275.) In an exemplary arrangement, the adjustment screws 293 are backed off and the pneumatic adjustment mechanisms 291 are set to provide a maximum pressure, thereby fully extending the pistons 292.

Next, the position of the ink pan 290 is adjusted to provide a predetermined gap between the fountain roller 201 and the anilox roller 275. In an exemplary embodiment, this is accomplished by using shims having a thickness corresponding to the predetermined gap. Note that the "corresponding to" terminology does not necessarily imply that thickness of the shim is exactly the same as the size of the predetermined gap, but rather means that there is a known relationship between the thickness of the shim and the size of predetermined gap.

In an insert shim(s) step 405, an operator inserts one or more shims between the fountain roller 201 and the anilox roller 275 at contact point 281. In a preferred embodiment, two shims are inserted, one at each end of the fountain roller 201 to provide for a consistent gap along the length of the contact point 281. In an exemplary arrangement, the shims have a thickness of 0.0075 inches. One skilled in the art will recognize that shims of different thicknesses can also be used in accordance with the method of the present invention.

An adjust position of ink pan step 410 is next used to adjust the position of the ink pan 290 to grip the shim(s) between the fountain roller 201 and the anilox roller 275. In an exemplary arrangement, this is done by turning the adjustment screw 293 to pivot the ink pan 290 about the pivot axis 206 until the shim is gripped between the fountain roller 201 and the anilox roller 275. In a preferred embodiment where one shim is inserted at each end of the fountain roller, the adjustment screws 293 on each side of the ink pan 290 can be adjusted to grip the corresponding shim. For example, the adjustment screw 293 in the near side (i.e., "operator side") height adjustment mechanism 297 can be turned until the shim on the near side of the ink tray is gripped, and the adjustment screw 293 in the far side (i.e., "gear side") height adjustment mechanism 297 can be turned until the shim on the far side of the ink tray is gripped.

Once the height adjustment mechanisms 297 have been adjusted to grip the shim(s) between the fountain roller 201 and the anilox roller 275, a remove shim(s) step 415 is used to remove the shim(s), pulling them out from between the fountain roller 201 and the anilox roller 275, leaving the fountain roller 201 and the anilox roller 275 positioned with the desired predetermined gap between them. It may be desirable to tighten the lock nuts 296 while the shims are being removed to maintain the ink pan 290 in a fixed position. Once the shims have been removed, the lock nuts 296 are then loosened before the next step is performed.

Next, an adjust position of ink pan step 420 is used to adjust the position of the ink pan 290 by a predetermined amount to close the predetermined gap between the fountain roller 201 and the anilox roller 275 and to provide the desired extent of contact between the rollers. Preferably, the position of the ink pan 290 is adjusted by using the height adjustment mechanism 297 to adjust the height of the distal portion of the ink pan 290, thereby pivoting the ink pan 290 about the pivot axis 206. In an exemplary arrangement, adjustment screws 293 have a known thread pitch, and the predetermined amount of adjustment is provided by turning the adjustment screws 293 by a predetermined angle in a predetermined direction. In an exemplary configuration, the adjustment screws 293 have a 20 threads/inch thread pitch, and the adjustment screws 293 are turned one complete turn (i.e., 360°) in a counter-clockwise direction, thereby lifting the distal end of the ink tray by 0.050 inches. (The fountain roller 201 is closer to the pivot axis 206 than the adjustment screws 293, therefore the fountain roller 201 will be lifted by a proportionally smaller amount.) In an exemplary arrangement, the adjustment screws 293 are turned manually using a wrench or a screwdriver. In other arrangements, the adjustment screws 293 can be turned using an automatic mechanism (e.g., a computer-controlled stepper motor).

The amount of adjustment in the height of the distal portion of the ink pan 290 that is required to provide the desired extent of contact between the fountain roller 201 and the anilox roller 275 will be coupled to the thickness of the shim(s) used in the insert shim(s) step 405. It is generally desirable that the amount that the adjustment screws 293 are to be turned in the adjust position of ink pan step 420 be a convenient and controllable amount (e.g., one complete turn or an integer number of turns). In an exemplary embodiment, the thickness of the shim(s) is selected to provide the desired extent of contact between the fountain roller 201 and the anilox roller 275 when the adjustment screws 293 are turned by one complete turn (i.e., by 360°). The thickness of the shim(s) needed to provide the desired extent of contact can be determined using any method known in the art. In an exemplary embodiment, the appropriate thickness of the shim(s) can be determined by using empirical process where a sequence of different shim thicknesses are used and the performance of the flexographic printing system 100 is evaluated for each shim thickness. The shim thickness that produces the best performance (e.g., the cleanest line profiles or the most consistent line widths in printed images) can then be selected for use in the ink pan adjustment process.

After the position of the ink pan 290 has been adjusted by the predetermined amount, a lock position of ink pan step 425 is used to lock the position of the ink pan 290 such that the distal portion of the ink pan 290 is maintained at the adjusted height. In an exemplary arrangement, the position of the ink pan 290 is locked into position by tightening the lock nuts 296 on the adjustment screws 293. In other arrangements, any locking mechanism known in the art (e.g., set screws) can be used to hold the ink pan 290 in a fixed position.

Figure 12:
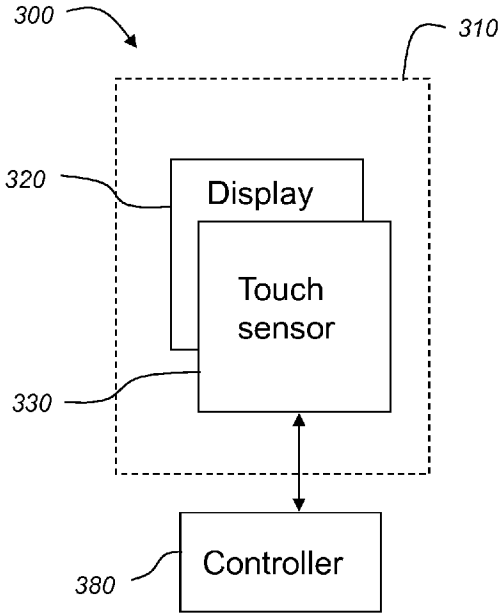
FIG. 12 is a high-level system diagram for an apparatus having a touch screen with a touch sensor that can be printed using embodiments of the invention.

FIG. 12 shows a high-level system diagram for an apparatus 300 having a touch screen 310 including a display device 320 and a touch sensor 330 that overlays at least a portion of a viewable area of display device 320. Touch sensor 330 senses touch and conveys electrical signals (related to capacitance values for example) corresponding to the sensed touch to a controller 380. Touch sensor 330 is an example of an article that can be printed on one or both sides by the flexographic printing system 100 including print modules that incorporate embodiments of ink recirculation system 250 and ink pans 200 described above.

Figure 13:
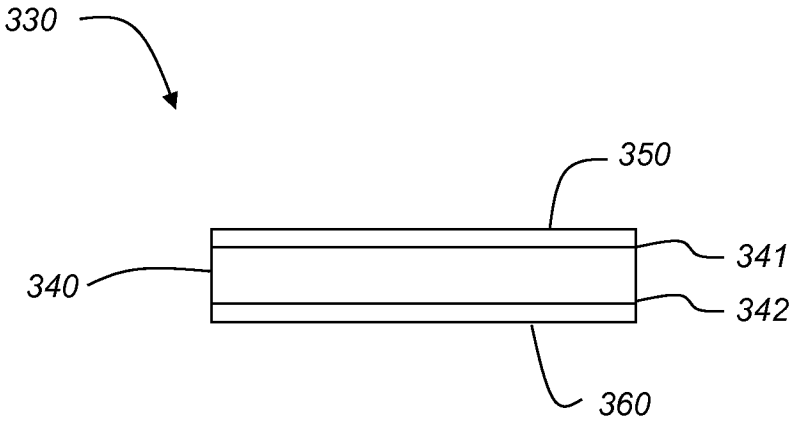
FIG. 13 is a side view of the touch sensor of FIG. 12.

FIG. 13 shows a schematic side view of a touch sensor 330. Transparent substrate 340, for example polyethylene terephthalate, has a first conductive pattern 350 printed on a first side 341, and a second conductive pattern 360 printed on a second side 342. The length and width of the transparent substrate 340, which is cut from the take-up roll 104 (FIG. 1), is not larger than the flexographic printing plates 112, 122, 132, 142 of flexographic printing system 100 (FIG. 1), but it could be smaller than the flexographic printing plates 112, 122, 132, 142. Optionally, the first conductive pattern 350 and the second conductive pattern 360 can be plated using a plating process for improved electrical conductivity after flexographic printing and curing of the patterns. In such cases it is understood that the printed pattern itself may not be conductive, but the printed pattern after plating is electrically conductive.

Figure 14:
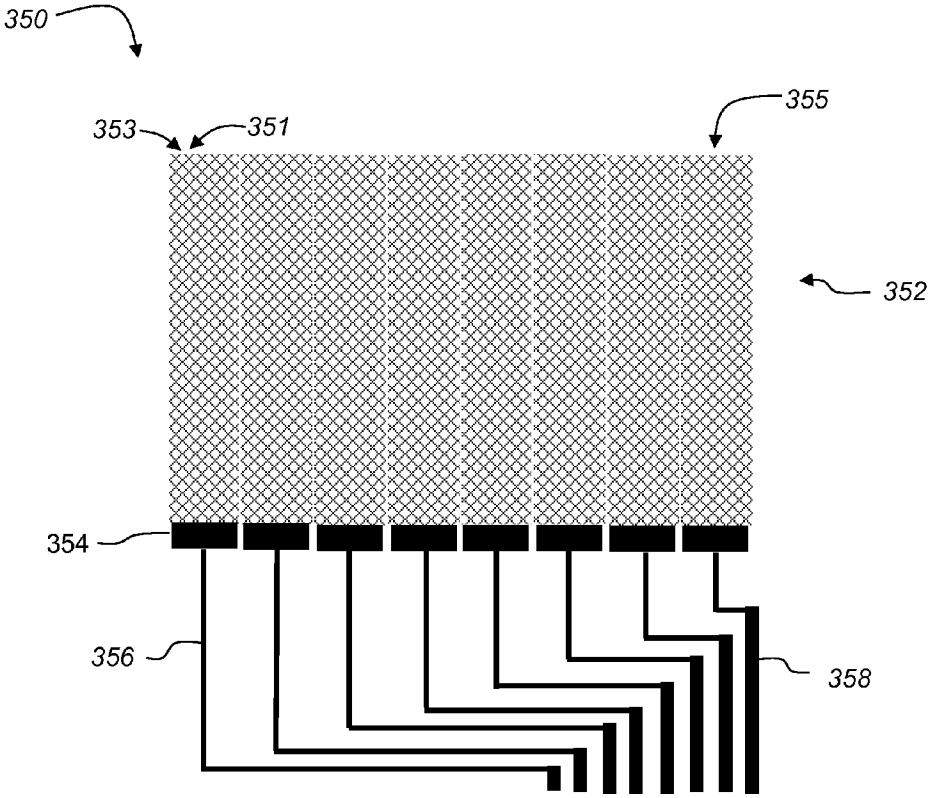
FIG. 14 is a top view of a conductive pattern printed on a first side of the touch sensor of FIG. 13.

FIG. 14 shows an example of a conductive pattern 350 that can be printed on first side 341 (FIG. 13) of substrate 340 (FIG. 13) using one or more print modules such as print modules 120 and 140 of flexographic printing system (FIG. 1). Conductive pattern 350 includes a grid 352 including grid columns 355 of intersecting fine lines 351 and 353 that are connected to an array of channel pads 354. Interconnect lines 356 connect the channel pads 354 to the connector pads 358 that are connected to controller 380 (FIG. 12). Conductive pattern 350 can be printed by a single print module 120 in some embodiments. However, because the optimal print conditions for fine lines 351 and 353 (e.g., having line widths on the order of 4 to 8 microns) are typically different than for printing the wider channel pads 354, connector pads 358 and interconnect lines 356, it can be advantageous to use one print module 120 for printing the fine lines 351 and 353 and a second print module 140 for printing the wider features. Furthermore, for clean intersections of fine lines 351 and 353, it can be further advantageous to print and cure one set of fine lines 351 using one print module 120, and to print and cure the second set of fine lines 353 using a second print module 140, and to print the wider features using a third print module (not shown in FIG. 1) configured similarly to print modules 120 and 140.

Figure 15:
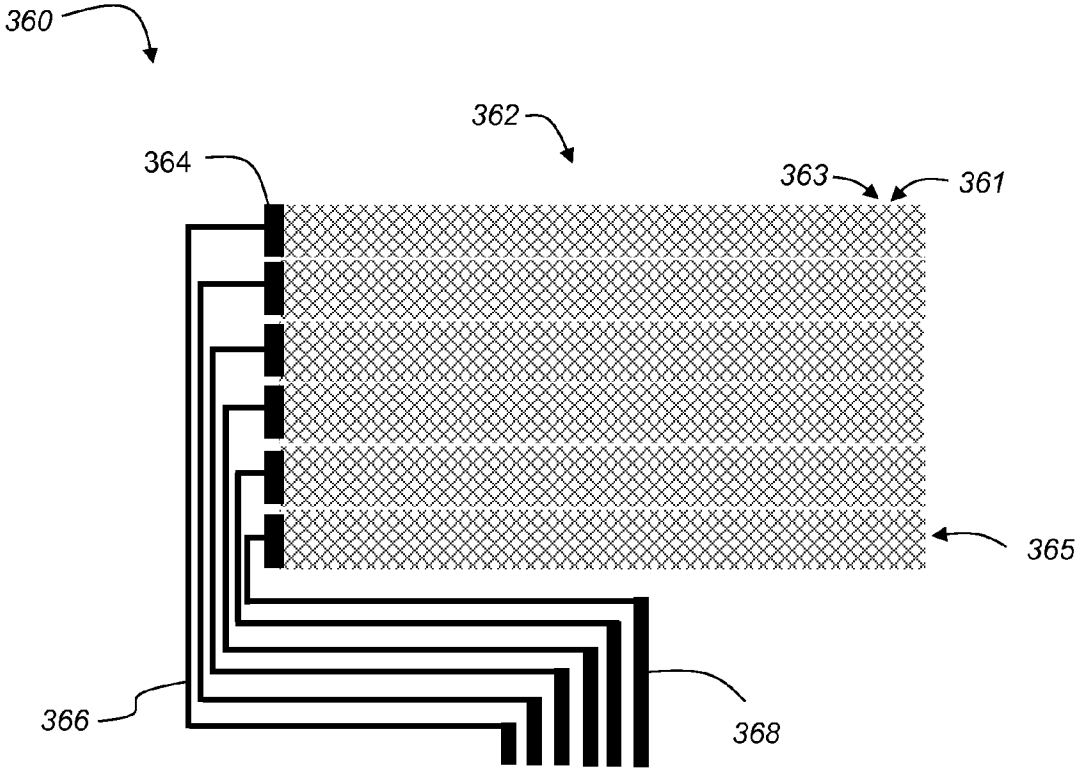
FIG. 15 is a top view of a conductive pattern printed on a second side of the touch sensor of FIG. 13.

FIG. 15 shows an example of a conductive pattern 360 that can be printed on second side 342 (FIG. 13) of substrate 340 (FIG. 13) using one or more print modules such as print modules 110 and 130 of flexographic printing system (FIG. 1). Conductive pattern 360 includes a grid 362 including grid rows 365 of intersecting fine lines 361 and 363 that are connected to an array of channel pads 364. Interconnect lines 366 connect the channel pads 364 to the connector pads 368 that are connected to controller 380 (FIG. 12). In some embodiments, conductive pattern 360 can be printed by a single print module 110. However, because the optimal print conditions for fine lines 361 and 363 (e.g., having line widths on the order of 4 to 8 microns) are typically different than for the wider channel pads 364, connector pads 368 and interconnect lines 366, it can be advantageous to use one print module 110 for printing the fine lines 361 and 363 and a second print module 130 for printing the wider features. Furthermore, for clean intersections of fine lines 361 and 363, it can be further advantageous to print and cure one set of fine lines 361 using one print module 110, and to print and cure the second set of fine lines 363 using a second print module 130, and to print the wider features using a third print module (not shown in FIG. 1) configured similarly to print modules 110 and 130.

Alternatively in some embodiments conductive pattern 350 can be printed using one or more print modules configured like print modules 110 and 130, and conductive pattern 360 can be printed using one or more print modules configured like print modules 120 and 140 of FIG. 1.

With reference to FIGS. 12-15, in operation of touch screen 310, controller 380 can sequentially electrically drive grid columns 355 via connector pads 358 and can sequentially sense electrical signals on grid rows 365 via connector pads 368. In other embodiments, the driving and sensing roles of the grid columns 355 and the grid rows 365 can be reversed.

The invention has been described in detail with particular reference to certain preferred embodiments thereof, but it will be understood that variations and modifications can be effected within the spirit and scope of the invention.

PARTS LIST

10 impression cylinder
12 substrate
14 plate cylinder
16 printing plate
18 anilox roller
20 fountain roller device
22 fountain roller
24 pan
26 doctor blade
30 reservoir chamber system
32 reservoir chamber
34 blade
38 ink exit
39 ink entry

46 blade
100 flexographic printing system
102 supply roll
104 take-up roll
105 roll-to-roll direction
106 roller
107 roller
110 print module
111 plate cylinder
112 flexographic printing plate
113 raised features
114 impression cylinder
115 anilox roller
116 UV curing station
120 print module
121 plate cylinder
122 flexographic printing plate
124 impression cylinder
125 anilox roller
126 UV curing station
130 print module
131 plate cylinder
132 flexographic printing plate
134 impression cylinder
135 anilox roller
136 UV curing station
140 print module
141 plate cylinder
142 flexographic printing plate
144 impression cylinder
145 anilox roller
146 UV curing station
150 substrate
151 first side
152 second side
160 ink pan
161 fountain roller
162 front wall
163 rear wall
164 floor
165 ink
166 pivot axis
167 lip
168 lowest portion
171 plate cylinder
172 flexographic printing plate
173 raised features
174 impression cylinder
175 anilox roller
176 UV curing station
177 imaging system
180 doctor blade
181 contact point
182 contact point
183 contact point
184 contact point
200 ink pan
201 fountain roller
202 front wall
203 rear wall
204 floor
205 ink
206 pivot axis
207 lip
208 lowest floor portion
210 blade holder
211 first side wall
212 second side wall
213 side wall
215 opening
220 doctor blade
230 ink distribution tube
232 ink supply port
233 pressure manifold
234 pressurized line
235 replenished ink entry path
239 ink drain line
240 ink recirculation port
241 ink recirculation line
242 ink recirculation pump
243 control system
244 filter
245 solvent replenishment chamber
246 metering pump
247 control system
248 valve
249 valve
250 ink recirculation system
251 ink recovery valve
252 valve
253 ink recovery tank
254 mixing device
255 density sensor
256 ink return line
257 solvent replenishment line
260 pivot element
261*a* upper contact point
261*b* first side contact point
261*c* lower contact point
261*d* second side contact point
262 bracket
263 bracket
264 clamping screw
265 pin
266 alignment pin
267 retaining ring
268 slot
268*a* slot direction
269 slot
269*a* slot direction
271 plate cylinder
272 flexographic printing plate
273 raised features
274 impression cylinder
275 anilox roller
276 UV curing station
277 imaging system
281 contact point
282 contact point
283 contact point
284 contact point
290 ink pan
291 pneumatic adjustment mechanism
292 piston
293 adjustment screw
294 block
295 block
296 lock nut
297 height adjustment mechanism
298 cylinder
299 frame
300 apparatus
310 touch screen
320 display device

330 touch sensor
340 transparent substrate
341 first side
342 second side
350 conductive pattern
351 fine lines
352 grid
353 fine lines
354 channel pads
355 grid column
356 interconnect lines
358 connector pads
360 conductive pattern
361 fine lines
362 grid
363 fine lines
364 channel pads
365 grid row
366 interconnect lines
368 connector pads
380 controller
400 position ink pan step
405 insert shim(s) step
410 adjust position of ink pan step
415 remove shim(s) step
420 adjust position of ink pan step
425 lock position of ink pan step
F force
P pressure
W width

The invention claimed is:

1. A method for adjusting an extent of contact between a fountain roller mounted to a pivotable ink pan and an anilox roller in a flexographic printing system, the pivotable ink pan being adapted to pivot around a pivot axis disposed proximate to a first end of the pivotable ink pan, comprising:

a) positioning the pivotable ink pan to provide a predetermined gap between the anilox roller and the fountain roller;

b) adjusting a position of the pivotable ink pan by adjusting a height of a distal portion of the pivotable ink pan by a predetermined amount, thereby repositioning the fountain roller to close the predetermined gap between the anilox roller and the fountain roller and provide a desired extent of contact between the anilox roller and the fountain roller; and c) locking the position of the pivotable ink pan such that the distal portion of the pivotable ink pan is maintained at the adjusted height.

2. The method of claim 1, wherein positioning the pivotable ink pan to provide the predetermined gap includes inserting a shim between the anilox roller and the fountain roller while the fountain roller is out of contact with the anilox roller, wherein the shim has a thickness corresponding to the predetermined gap.

3. The method of claim 2, wherein positioning the pivotable ink pan to provide the predetermined gap further includes positioning the pivotable ink pan so that the shim is gripped between the anilox roller and the fountain roller.

4. The method of claim 3, wherein the positioning of the pivotable ink pan includes pivoting the pivotable ink pan around the pivot axis.

5. The method of claim 4, wherein the pivotable ink pan is pivoted by modifying the height of the distal portion of the pivotable ink pan.

6. The method of claim 5, wherein modifying the height of the distal portion of the pivotable ink pan includes actuating a pneumatic drive mechanism or a hydraulic drive mechanism.

7. The method of claim 5, wherein modifying the height of the distal portion of the pivotable ink pan includes turning an adjustment screw.

8. The method of claim 3, wherein positioning the pivotable ink pan to provide the predetermined gap further includes removing the shim after the position of the pivotable ink pan has been adjusted to grip the shim between the anilox roller and the fountain roller.

9. The method of claim 1, wherein adjusting the height of the distal portion of the pivotable ink pan includes turning an adjustment screw or an adjustment nut having a known thread pitch by a predetermined angle in a predetermined direction.

10. The method of claim 1, wherein locking the position of the pivotable ink pan includes tightening a lock nut.

* * * * *